US007424753B2

(12) United States Patent
Gruenwald

(10) Patent No.: US 7,424,753 B2
(45) Date of Patent: Sep. 16, 2008

(54) SPA WITH PLASTIC FOOT PLATE AND SEAL THEREFOR

(75) Inventor: David J. Gruenwald, Butte Des Morts, WI (US)

(73) Assignee: European Touch Holdings, Inc., Milwaukee, WI (US)

( * ) Notice: Subject to any disclaimer, the term of this patent is extended or adjusted under 35 U.S.C. 154(b) by 185 days.

(21) Appl. No.: 10/944,534

(22) Filed: Sep. 17, 2004

(65) Prior Publication Data

US 2005/0183197 A1 Aug. 25, 2005

Related U.S. Application Data

(63) Continuation-in-part of application No. 10/385,916, filed on Mar. 11, 2003, now Pat. No. 6,880,182.

(60) Provisional application No. 60/436,128, filed on Dec. 23, 2002.

(51) Int. Cl.
*A47K 3/10* (2006.01)

(52) U.S. Cl. ..... 4/541.1

(58) Field of Classification Search ..... 4/541.1–541.6, 4/546, 621, 622
See application file for complete search history.

(56) References Cited

U.S. PATENT DOCUMENTS

| | | | | |
|---|---|---|---|---|
| 2,061,142 | A | 11/1936 | Denocenzo | |
| 2,312,524 | A | 3/1943 | Cox | |
| 2,417,499 | A | 3/1947 | Ille | |
| 2,733,711 | A | 2/1956 | Gibson | |
| 2,738,787 | A | 3/1956 | Jacuzzi et al. | |
| 3,159,849 | A | 12/1964 | Jacuzzi | |
| 3,273,560 | A | 9/1966 | Jacuzzi | |
| 3,287,741 | A | 11/1966 | Nash | |
| 3,297,025 | A | 1/1967 | Jacuzzi | |
| 3,940,807 | A | 3/1976 | Baker et al. | |
| 3,964,471 | A | 6/1976 | Saethre | |
| 3,965,495 | A | 6/1976 | McNair | |
| 4,004,302 | A | 1/1977 | Hori | |
| 4,100,917 | A | 7/1978 | Talge et al. | |
| 4,115,878 | A | 9/1978 | Johnson et al. | |
| 4,168,705 | A | 9/1979 | Raab | |
| 4,184,488 | A | 1/1980 | Bielich | |
| 4,281,423 | A * | 8/1981 | Fukunaga et al. | 4/537 |
| 4,330,412 | A | 5/1982 | Frederick | |
| 4,349,434 | A | 9/1982 | Jaworski | |
| 4,420,846 | A | 12/1983 | Bonner | |
| 4,485,503 | A | 12/1984 | Rolando et al. | |

(Continued)

FOREIGN PATENT DOCUMENTS

| | | |
|---|---|---|
| JP | 646964 | 2/1994 |

(Continued)

*Primary Examiner*—Huyen Le
(74) *Attorney, Agent, or Firm*—Reinhart Boerner Van Dueren s.c.

(57) ABSTRACT

A spa apparatus includes a basin for retaining fluid, a removable foot rest plate positioned within the basin, an impeller, and a motor coupled to the impeller to create a high pressure zone in the basin underneath the foot rest plate. The foot rest plate may be made of a plastic material. A seal is provided between the foot rest plate and the basin such that the seal is maintained even if the foot rest plate is deflected or distorted by the water pressure underneath it.

24 Claims, 18 Drawing Sheets

U.S. PATENT DOCUMENTS

| | | | | |
|---|---|---|---|---|
| 4,520,525 | A | | 6/1985 | Yogi et al. |
| 4,525,881 | A | | 7/1985 | Higginbotham |
| 4,665,572 | A | | 5/1987 | Davidson et al. |
| 4,742,584 | A | | 5/1988 | Abe |
| 4,853,987 | A | | 8/1989 | Jaworski |
| 4,903,352 | A | | 2/1990 | Murakami |
| 4,984,583 | A | | 1/1991 | Peterson et al. |
| 5,044,357 | A | | 9/1991 | Johns |
| 5,083,329 | A | | 1/1992 | Murakami |
| 5,588,161 | A | | 12/1996 | Barradas |
| 5,729,841 | A | | 3/1998 | Chan |
| 5,947,131 | A | * | 9/1999 | Kim ..... 4/622 |
| 6,003,166 | A | | 12/1999 | Hald et al. |
| D429,379 | S | | 8/2000 | Kim |
| D434,916 | S | | 12/2000 | Galati, Jr. et al. |
| D435,937 | S | | 1/2001 | Back et al. |
| 6,357,059 | B1 | | 3/2002 | Lau |
| D455,017 | S | | 4/2002 | Tran |
| D455,566 | S | | 4/2002 | Park |
| D456,154 | S | | 4/2002 | Huynh et al. |
| 6,363,548 | B1 | | 4/2002 | Kuo |
| 6,393,633 | B2 | | 5/2002 | Ferber |
| 6,438,768 | B1 | | 8/2002 | Yen |
| 6,598,244 | B1 | | 7/2003 | Yeh |

FOREIGN PATENT DOCUMENTS

| | | |
|---|---|---|
| JP | 678858 | 3/1994 |
| JP | 6339509 | 12/1994 |

* cited by examiner

SPA WITH PLASTIC FOOT PLATE AND SEAL THEREFOR

The present application is a continuation-in-part of U.S. patent application Ser. No. 10/385,916, filed on Mar. 11, 2003, now U.S. Pat. No. 6,880,182 and claims priority to U.S. Provisional Application No. 60/436,128, filed Dec. 23, 2002, both of which are entitled "Spa Apparatus" by Gruenwald and are incorporated by reference herein.

FIELD OF THE INVENTION

The present invention relates to a spa device. In particular, the present invention relates to a spa apparatus for use in activities related to a foot massage.

BACKGROUND OF THE INVENTION

It is generally known to provide for a spa device, such as health spas, whirlpools, jet stream exercisers, foot spas, etc. Such known spa devices are typically used in commercial and recreational settings for hydrotherapy, massage, stimulation, pedicure, and bathing purposes. However, such spa devices have several disadvantages including being difficult to thoroughly clean, requiring complicated maintenance schedules, and often providing harsh and uncomfortable massages.

Water quality can become a problem in systems that use circulating water that comes into contact with the human body where the spa is not thoroughly cleaned. Several actions have been taken in an attempt to overcome this difficulty, including the addition of chemicals (e.g., bleach) into the water to help control bacteria growth. Despite such efforts, however, water quality is sometimes still difficult to maintain. For example, bacteria can develop simple defense mechanisms to counter chemical attacks such as forming a protective outer coating that acts as a barrier against harsh chemical treatments. The destruction of the outer coating is generally difficult with chemicals alone. Often times, chemicals are only effective in destroying the outer coating when used for extended periods of time, sometimes hours. Therefore, the preferred method of eliminating bacteria from systems is through mechanical means such as abrasion (e.g., removal with a rag and a chemical cleanser that has anti-bacterial capabilities).

Furthermore, many spa devices have intricate and elaborate systems of pipes that move water from a pump, through a filtering system, and ultimately to one or more nozzles (e.g., openings) that deliver water back to a basin for re-circulation. In the case of a pedicure basin, the process of cleaning after each pedicure involves draining the water from the system, spraying the basin with some type of anti-bacterial cleanser, circulating the water for a period of time, rinsing and then refilling with fresh water. Because there are pipes and fittings, it is often difficult to mechanically scrub every component that comes into contact with water. In addition, after a system is drained, some water may remain within the piping system, usually in cracks and crevices or low spots in the pumping system. For example, the pump itself is usually a sealed unit that may be difficult to completely drain. It is within these areas that the bacteria tend to grow the outer coating as a defensive mechanism against attack from anti-bacterial chemicals, especially when the pedicure system is not used for extended periods (e.g., overnight, weekends, etc.). Consequently, water quality may be diminished in conventional piped systems that are not effectively cleaned.

Another problem with known spa devices is that they often provide a harsh massaging effect to the feet by pointing a small number of nozzles (e.g., openings) toward the top of the feet. These nozzles are generally connected via pipes and hoses to a single centrifugal pump that produces a very high pressure (20-40 psi) and a relatively low volume of water. Customers often complain that the jets of water produced in this manner are too rough, in some cases even producing pain or discomfort. Although the jets can be partially closed to reduce the force of the water stream, this also reduces the water volume. Consequently, the massage effect is minimized since the jets are often a considerable distance away from the feet (e.g., in the walls of the basin).

An example of an existing system is disclosed in U.S. Pat. No. 2,312,524 issued to William B. Cox. Specifically, Cox discloses a foot bathing device that utilizes foot rests consisting of a disk of heavy wire screening or a perforated plate (see col. 1, lines 43-44). This type of system can have several disadvantages including producing unrestricted streams of water. For example, Cox discloses the use of a flat foot rest containing a uniform pattern of openings across the entire foot rest that is not capable of directing the water in any particular direction (e.g., a foot rest that includes a uniform grid pattern across the entire foot rest).

Accordingly, it would be advantageous to provide a spa apparatus that substantially avoids the problems of bacterial growth by eliminating the need for pipes and/or pumps. Further, it would be advantageous to provide a spa apparatus with a removable foot rest plate for easy access to clean the basin and exposed components. It would also be advantageous to provide a spa apparatus that produces an improved massage of the foot by directing a flow of water at a much lower pressure while still maintaining a higher volume of water to specific areas of the foot. In addition, it would be advantageous to provide a spa apparatus that substantially eliminates the water fountain effect (e.g., excess splashing) sometimes found in other pedicure systems. It would be desirable to provide for a spa apparatus having one or more of these or other advantageous features.

SUMMARY OF THE INVENTION

A feature of the present invention is to provide a spa apparatus that overcomes the above-noted disadvantages.

Another feature of the present invention is to provide a spa apparatus that does not require circulation pipes or pumps, thereby reducing the bacteria problem within the apparatus.

Another feature of the present invention is to provide a spa apparatus with a removable foot rest plate that allows for easy access to clean the spa components exposed to water.

Another feature of the present invention is to provide a spa apparatus that does not require tools to install and/or remove the foot plate and/or screen.

Another feature of the present invention is to provide a spa apparatus that minimizes the water fountain effect.

Another feature of the present invention is to provide a spa apparatus that includes a safety mechanism that stops the impeller from rotating when the screen or foot rest plate is removed.

A still further feature is to provide a spa apparatus with a removable foot rest plate that sealingly engages the bottom of a basin to form a high pressure zone between the foot rest plate and the bottom of the basin.

Another feature of the present invention is to provide a spa apparatus with a removable foot rest plate that can be made inexpensively of a plastic material.

Another feature of the present invention is to provide an improved seal between the foot rest plate and the basin such that the seal is maintained to form a high pressure zone between the foot rest plate and the bottom of the basin even if the foot rest plate, made of a plastic or other material, is deflected or distorted by the pressure underneath the plate.

How these and other advantages and features of the present invention are accomplished (individually, collectively, or in various subcombinations) will be described in the following detailed description of the preferred and other exemplary embodiments, taken in conjunction with the FIGURES.

One embodiment of the invention provides a spa apparatus that includes a basin for retaining fluid. Further, the spa apparatus includes a foot rest plate removably positioned within the basin, the foot rest plate including a plurality of openings and at least one area without openings. The spa apparatus also includes an impeller coupled to the basin and a motor drivably coupled to the impeller.

Another embodiment of the invention provides a spa apparatus including a basin for retaining fluid. Further, the spa apparatus includes a foot rest plate removably positioned within the basin, the foot rest plate including a plurality of openings and at least one non-horizontal region. The spa apparatus also includes an impeller coupled to the basin and a motor drivably coupled to the impeller.

Another embodiment of the invention provides a basin for retaining fluid having a floor. A foot plate is operatively sealed to the basin. A first region is defined by an area between the foot plate and the floor of the basin. The foot plate includes an intake opening and at least one output opening. An impeller is located between a top surface of the plate and the floor of the basin and configured to draw fluid through the intake opening into the first region and to force the water out of the first region through the output opening.

In another embodiment, a water spa includes a basin configured to hold water. A removable foot rest plate having an upper surface is operatively secured to the basin below the free surface of the water. The foot rest plate includes an inlet opening and at least one output opening. A pump is configured to draw water through the inlet opening into a region below the foot rest plate and to distribute the water to the output opening under a pressure greater than the fluid pressure of the water above the foot rest plate.

Another embodiment of the invention provides a method of cleaning a spa apparatus including removing a foot rest plate from the spa apparatus. In addition, the method includes mechanically cleaning the spa apparatus with a cleanser, including each component exposed to fluid during use of the spa apparatus. Further, the method includes replacing the foot rest plate in the spa apparatus.

In another embodiment of the present invention the foot rest plate, as described variously above and in the detailed description to follow, is made of a plastic material, such as glass polypropylene, or any similar or different plastic material that does not absorb water. The foot rest plate thus may be manufactured inexpensively by a plastic molding or similar plastic forming process.

In another embodiment of the present invention a seal is provided between the foot rest plate and the basin such that the seal is maintained even if the foot rest plate is deflected or distorted by the water pressure underneath it. In this embodiment the foot rest plate may include an outer peripheral flange that rests on a substantially horizontal shelf formed in substantially vertical sidewalls of the basin. The seal, made of a flexible material, e.g., Santoprene, silicone rubber, TPR (thermo plastic rubber), EPDM (ethylene-propylene-diene rubber, etc.), may be mounted in a groove or other mounting structure formed in the bottom surface of the foot rest plate inward from the peripheral edge thereof. The seal is shaped to extend along the length thereof downward from the foot rest plate adjacent to the substantially vertical sidewalls of the basin extending below the substantially horizontal shelf formed therein. The seal is in contact with the sidewalls of the basin at or near the distal end thereof below the substantially horizontal shelf along the length thereof to form a seal between the foot rest plate and the sidewalls of the basin. As pressure underneath the foot rest plate causes the plate to deflect upward along the peripheral edge thereof, thereby causing the peripheral edge of the plate to move upward and away from the substantially horizontal shelf upon which it rests, the portion of the seal extending downward from the plate is flexed outward toward the sidewalls of the basin, thereby to maintain and enhance the seal formed between the foot rest plate and the basin.

The present invention further relates to various features and combinations of features shown and described in the disclosed embodiments. Other ways in which the objects and features of the disclosed embodiments are accomplished will be described in the following specification or will become apparent to those skilled in the art after they have read this specification.

Figure 1:
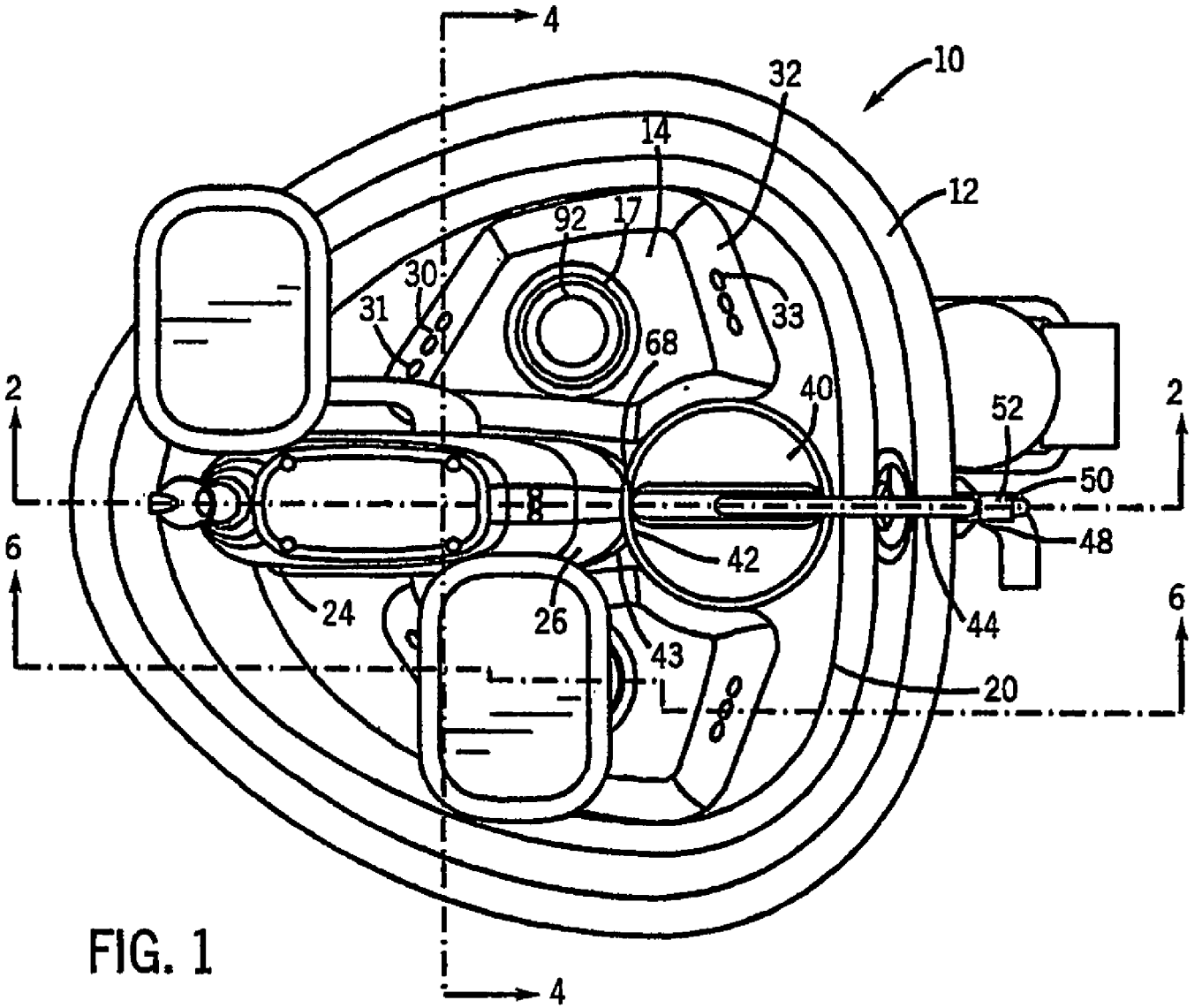
FIG. 1 is a top plan view of the spa apparatus according to an exemplary embodiment.

Before describing a number of preferred, exemplary, and alternative embodiments of the invention in detail, it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF PREFERRED AND OTHER EXEMPLARY EMBODIMENTS

Before proceeding to the detailed description of the preferred and exemplary embodiments, several comments can be made about the general applicability and the scope thereof.

First, while the components of the disclosed embodiments will be illustrated as a spa apparatus designed for feet or foot spas, the features of the disclosed embodiments have a much wider applicability. For example, the spa design is adaptable for other spa devices including spas for hands, other body parts, entire bodies, etc. Further, the size of the various components and the size of the apparatus can be widely varied.

Second, the particular materials used to construct the exemplary embodiments are also illustrative. For example, the basin of the spa apparatus may be made from a scratch resistant material such as borosilicate or other suitable material. Further, components of the spa apparatus can be manufactured from thermoplastic resins such as injection molded high density polyethylene, polypropylene, other polyethylenes, acrylonitrile butadiene styrene ("ABS"), polyurethane, nylon, any of a variety of homopolymer plastics, copolymer plastics, plastics with special additives, filled plastics, etc. Also, other molding operations may be used to form these components, such as blow molding, rotational molding, etc. In addition, various components of the spa apparatus can be manufactured from stamped alloy materials such as steel or aluminum.

Proceeding now to descriptions of the preferred and exemplary embodiments, FIGS. 1-7 show spa apparatus 10 according to a preferred embodiment. Spa apparatus 10 is configured for use in foot massages, pedicures, and other activities related to the feet, including bathing, soaking, stimulating, etc.

Spa apparatus 10 includes a basin 12 configured to retain fluid (e.g., water) for use with various cleaning and/or massage activities. Spa apparatus 10 also includes a foot rest plate 14 positioned within the basin, an impeller 16 coupled to basin 12, and a motor 18 located external to the basin for rotating impeller 16 so that fluid is directed through foot rest plate 14.

Figure 3:
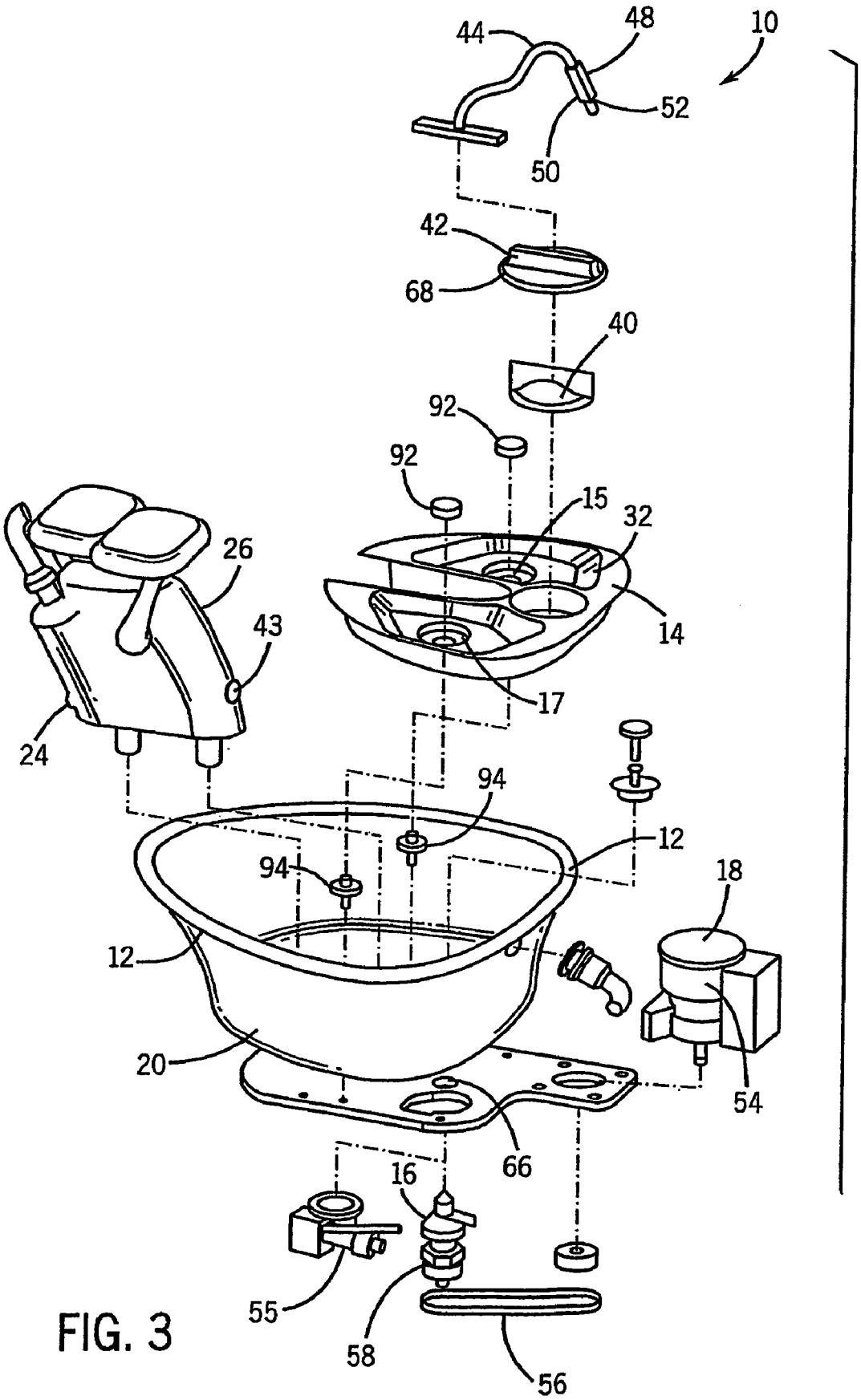
FIG. 3 is an exploded perspective view of the spa apparatus according to an exemplary embodiment.
Figure 4:
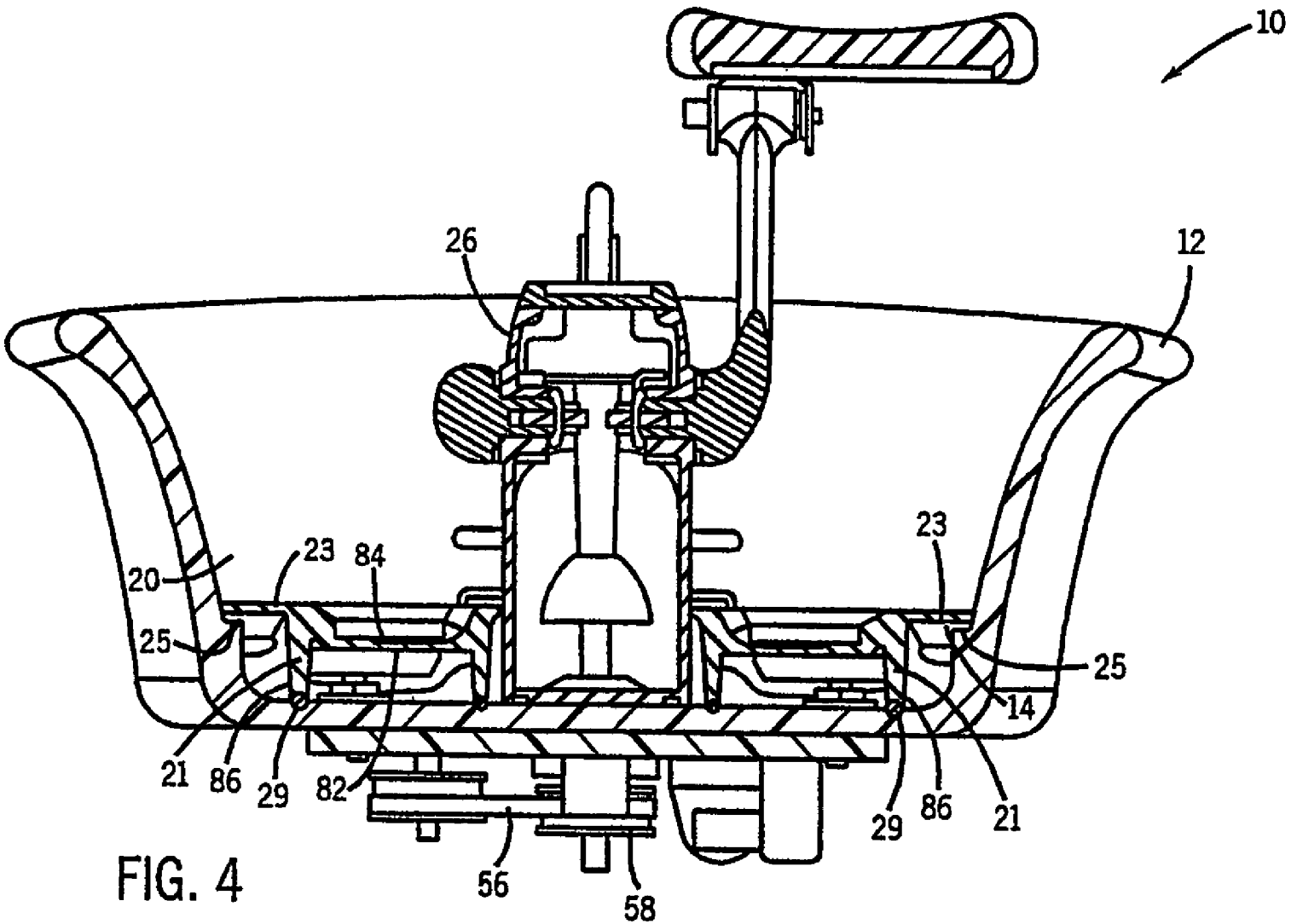
FIG. 4 is a sectional view of the spa apparatus taken along line 4-4 of FIG. 1.
Figure 5:
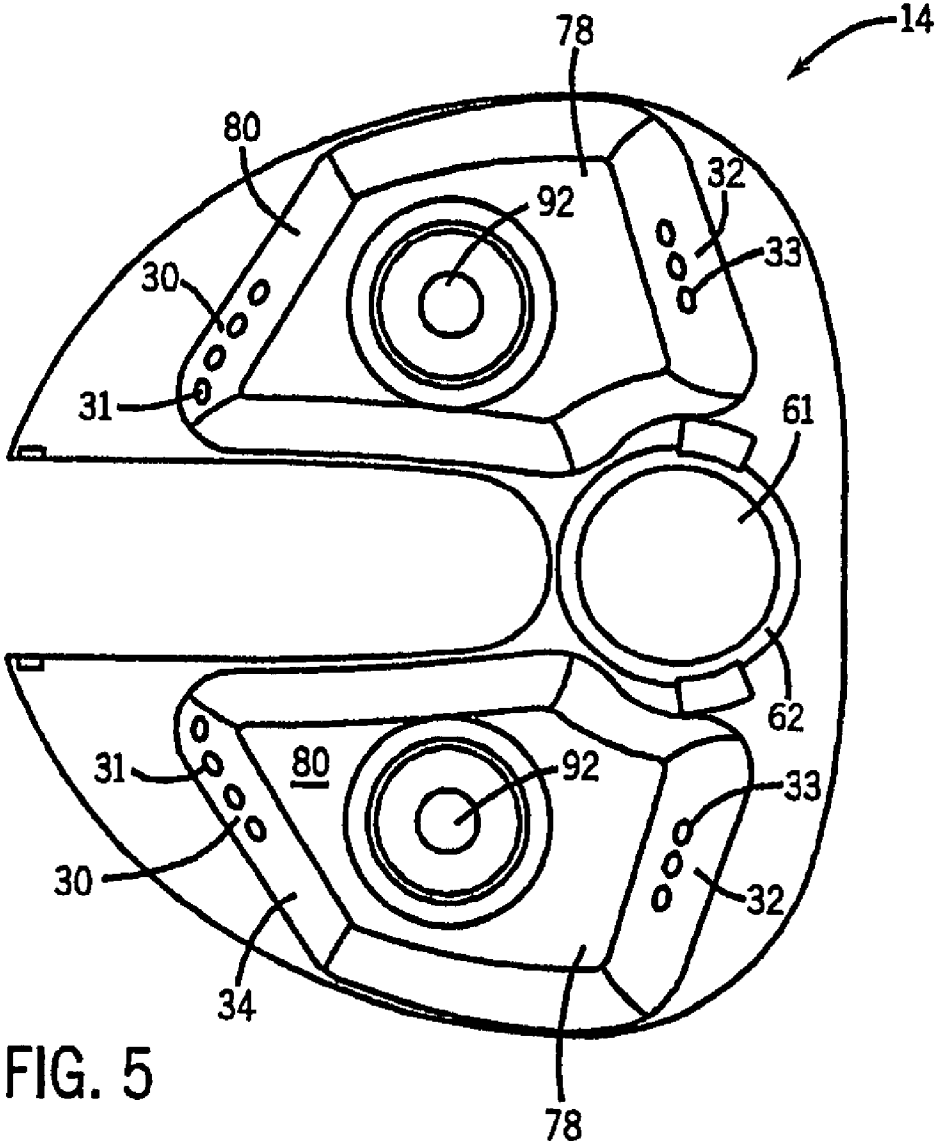
FIG. 5 is a top plan view of a foot rest plate according to an exemplary embodiment.
Figure 6:
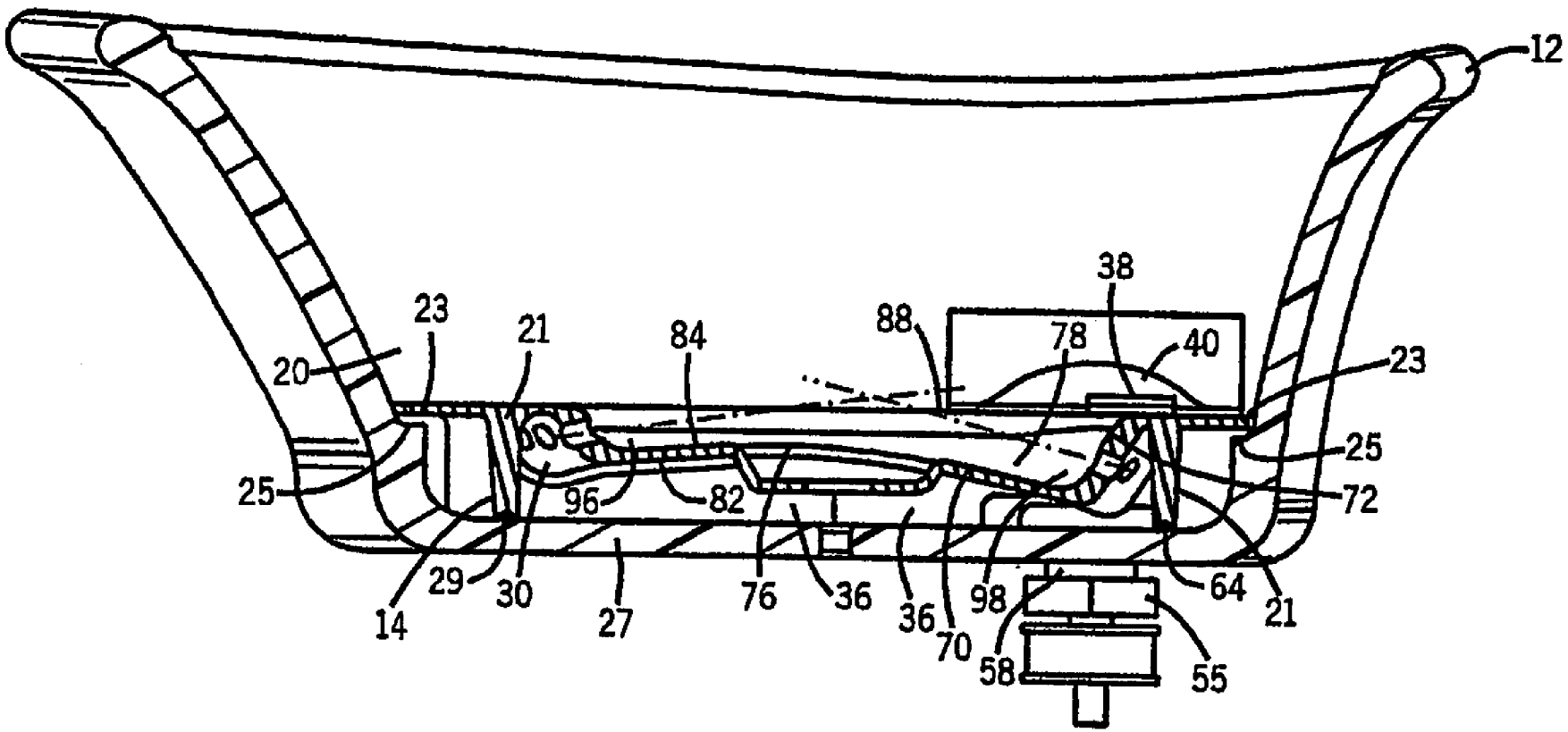
FIG. 6 is a sectional view of a foot rest plate taken along line 6-6 of FIG. 1.
Figure 7:
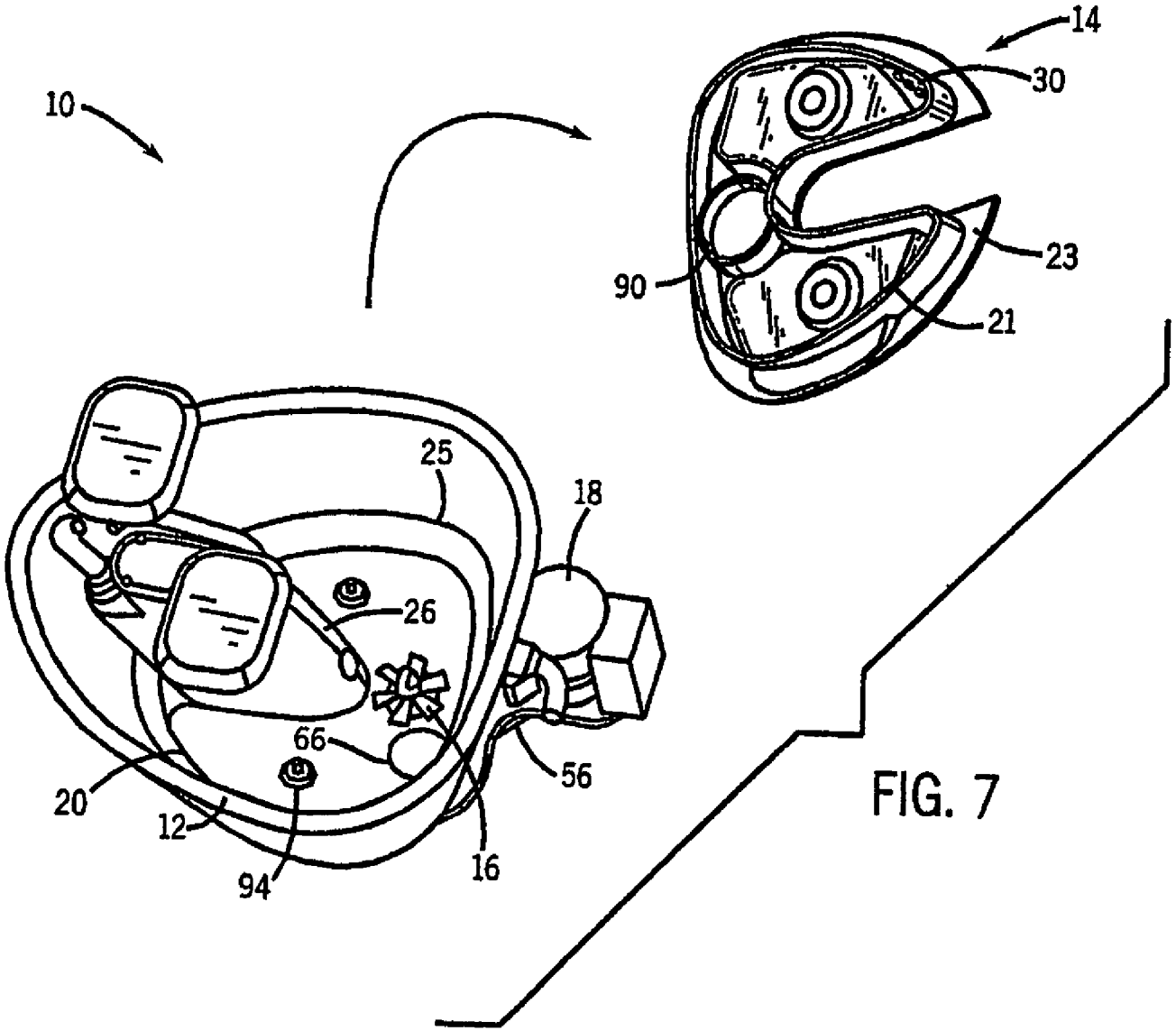
FIG. 7 is an exploded perspective view of the spa apparatus configured so that it may be cleaned according to an exemplary embodiment.
Figure 8:
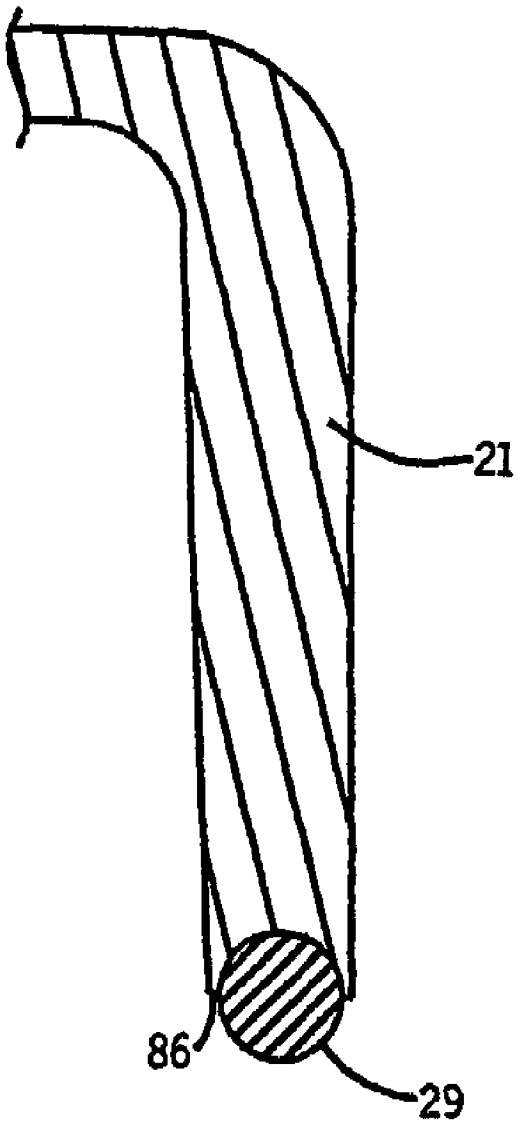
FIG. 8 is a partial sectional view of a foot rest plate taken generally along line 8-8 of FIG. 6.
Figure 9:
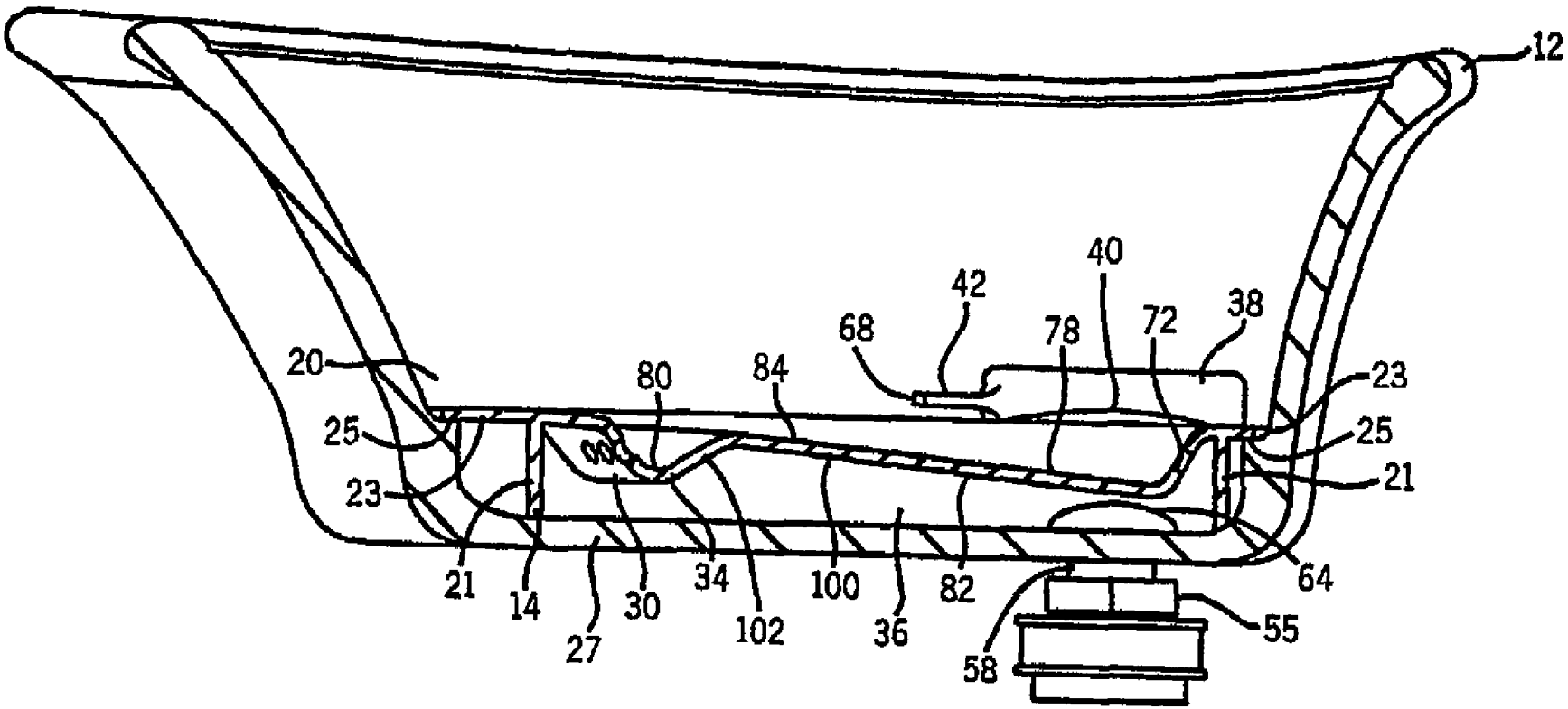
FIG. 9 is a sectional view of a foot rest plate according to an alternative embodiment.

Foot rest plate 14 is preferably positioned in the lower portion 20 of basin 12. According to an exemplary embodiment, foot rest plate 14 is removably coupled to basin 12 below the fluid surface, and in the preferred embodiment rests on the floor of basin 12. Foot rest plate 14 forms a seal with the floor or bottom surface 27 of basin 12 to restrict the flow of fluid around foot rest plate 14. Referring to FIGS. 6-8, foot rest plate 14 includes a lower ridge 21 having a neoprene sealing ring 29 located in a groove 86 to form a seal when foot rest plate 14 makes contact with basin 12. The seal may be formed between lower ridge 21 and bottom surface 27 of basin 12 and/or between upper ridge 23 and ledge 25 of basin 12. In a preferred embodiment, foot rest plate 14 is held in position within basin 12 by caps 92. As shown in FIG. 3, caps 92 are removably coupled to fasteners 94 which are fixedly attached to basin 12. Fasteners 94 are positioned in basin 12 to protrude through apertures 15 on foot rest plate 14 when foot rest plate 14 is positioned within basin 12. Foot rest plate 14 includes fastener cavities 17 where fasteners 94 and caps 92 may be coupled together without interfering with operation of apparatus 10. Caps 92 are coupled to fasteners 94 by threading caps 92 onto fasteners 94 until a desired seal is obtained. Caps 92 are coupled to fasteners 94 with sufficient force to secure foot rest plate 14 within basin 12 to prevent any leaking within apparatus 10 during operation of the system. Alternatively, caps 92 may be coupled to fasteners 94 by a variety of other methods such as, for example, clamping, screwing, hooking, clipping, snapping, etc. Caps 92 form seals with foot rest plate 14 after being coupled to fasteners 94. Similarly, fasteners 94 form seals with basin 12. According to an alternative embodiment as shown in FIG. 9, foot rest plate 14 may be held in position within basin 12 by a protrusion 24 on the side of a center console 26 that is positioned within basin 12. Alternatively, foot rest plate 14 may be held in position within basin 12 by various fastening or joining methods (e.g., fastening, clamping, hooking, sliding, etc.). According to a preferred embodiment, foot rest plate 14 is configured so that a user may easily remove plate 14 without tools. This allows a user easy access to mechanically clean (e.g., scrub with a cleanser such as water, soap, detergent, disinfectant, antiseptic, etc.) the components of spa apparatus 10 that are exposed to water.

In the particular embodiment illustrated, foot rest plate 14 includes a first nozzle system 30 and a second nozzle system 32. Nozzle system 30 is positioned on foot rest plate 14 to direct a stream of fluid in a non-vertical direction. Nozzle system 30 includes at least a first opening 31 configured to direct fluid in a non-vertical direction. More specifically, opening 31 is configured to direct a stream of fluid at the front of the foot, including the toes. Nozzle system 32 is positioned on foot rest plate 14 to direct a stream of fluid in a non-vertical direction. Nozzle system 32 includes at least a second opening 33 configured to direct fluid in a non-vertical direction. More specifically, opening 33 is configured to direct a stream of fluid at the back of the foot, including the heel. As used in this application, the vertical direction is a generally upward direction parallel to the vertical plane. Further, the vertical plane is perpendicular to the horizontal plane or the plane of resting fluid within the basin.

Foot rest plate 14 is configured so that users are able to move their feet to adjust the location of nozzle systems 30 and 32 relative to their feet. In effect, this allows users to control how the water exiting nozzle systems 30 and 32 makes contact with their feet. As shown in FIG. 6, foot rest plate 14 has an overall configuration that approximates the general shape and/or curvature of the human foot. First opening 31 of nozzle system 30 may be positioned at an angle 96 of about 0 to 30 degrees with respect to the horizontal plane. According to a preferred embodiment, water exits first opening 31 at an angle 96 of about 8 degrees with respect to the horizontal plane. Additionally, second opening 33 may be positioned such that water may exit at an angle 98 of about 0 to 40 degrees. According to a preferred embodiment, water exits second opening 33 at an angle 98 of about 15 degrees with respect to the horizontal plane. Further, by placing the first opening 31 and the second opening 33 at the described angles and having the two streams of fluid collide near the center of the basin, the water fountain effect can be greatly diminished. For example, when openings 31 and 33 are positioned directly opposite one another so that the fluid streams intersect and have a canceling effect on each other, the resultant fluid stream vector has a minimized vertical component. Consequently, splashing from the spa apparatus is greatly diminished. Alternatively, openings 31 and 33 may be positioned so that the resultant fluid flows do not directly intersect. For example, openings 31 and 33 may be positioned so that the fluid exiting openings 31 and 33 are parallel to one another. This may be accomplished by offsetting openings 31 and 33 so they do not lie directly opposite one another, directing openings 31 and 33 to produce parallel flows, etc.

Further, openings 31 and 33 are arranged in a non-uniform pattern on foot rest plate 14. As used in this application, the term "uniform" means consistent throughout an entire area. For example, screens and grids are often characterized by uniform perforations or openings over the entire surface of the screen or grid. Each opening or perforation is generally uniform in shape and distribution throughout the object. Since foot rest plate 14 has a non-uniform pattern of openings, plate 14 includes at least one area without any perforation or openings. In other words, foot rest plate 14 does not have an even and continuous distribution of openings across its entire surface.

Foot rest plate 14 serves several purposes. For example, foot rest plate 14 provides support for the foot at a desired angle for comfort. In addition, foot rest plate 14 protects the foot from contact with the rotating impeller housed beneath it. Further, foot rest plate 14 confines, constricts, and directs the flow of water from impeller 16 to nozzle systems 30 and 32 formed in the foot rest plate. Furthermore, foot rest plate 14 also serves to divide basin 12 into a high pressure zone 36 and a low pressure zone 38. The high pressure zone 36 is located between basin 12 and the bottom of foot rest plate 14 whereas low pressure zone 38 is located above the top of foot rest plate 14. Consequently, the cavity formed between basin 12 and foot rest plate 14 (e.g., high pressure zone 36) takes the place of, and in effect replaces the pipes in a conventional pipe system.

Figure 2:
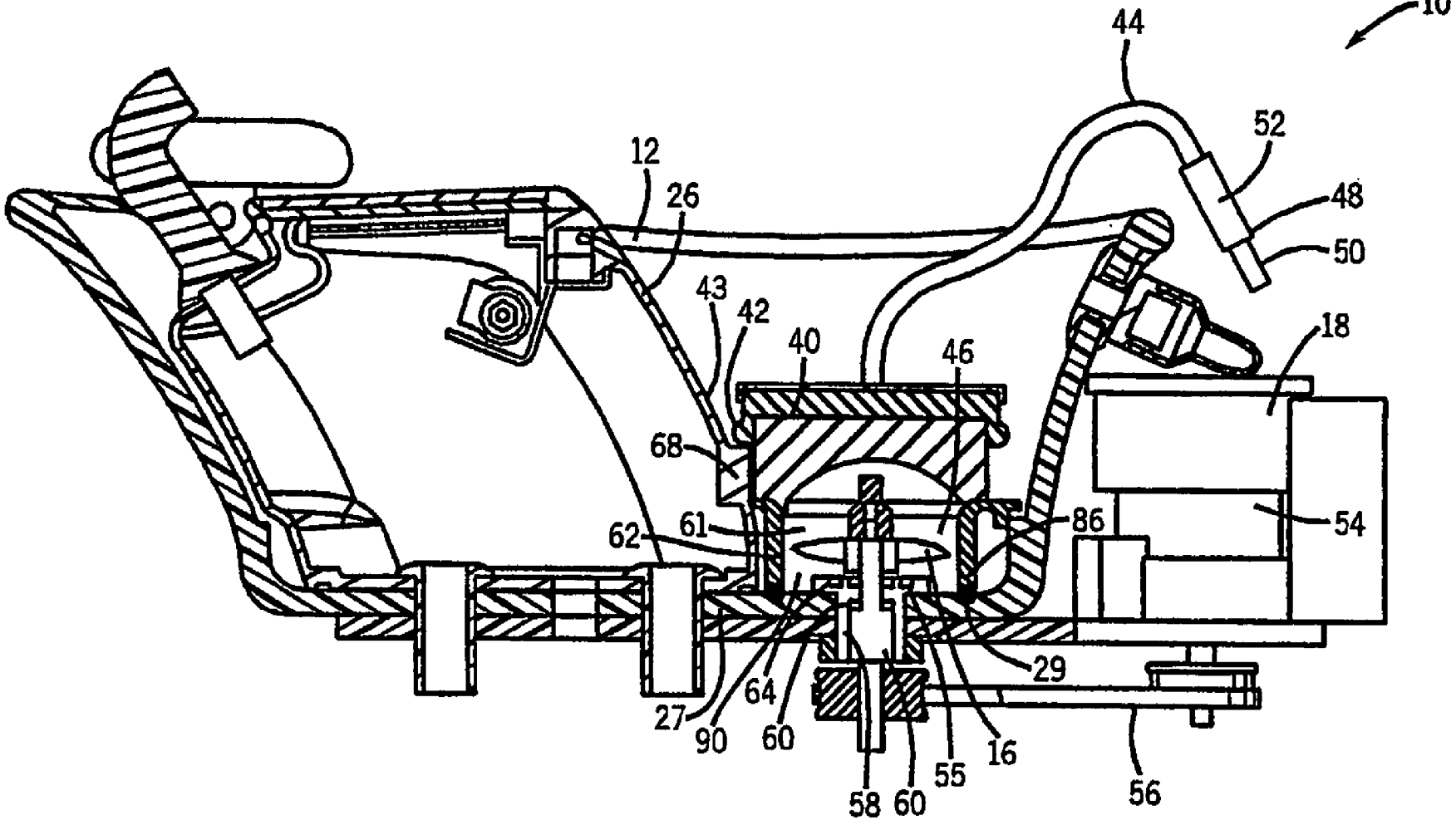
FIG. 2 is a sectional view of the spa apparatus taken along line 2-2 of FIG. 1.

A screen 40 is configured to be positioned over the opening of inlet or intake 61 of foot rest plate 14 and is coupled to console 26 and/or foot rest plate 14. Referring to FIG. 2, tab 42 on screen 40 abuts edge 43 on console 26. Alternatively, screen 40 may be coupled to foot rest plate 14 and/or console 26 by various fastening or joining methods (e.g., fastening, clamping, hooking, sliding, etc.). Alternatively, screen 40 may be integrally formed as part of a single unitary body with foot rest plate 14 and/or console 26. Moreover, in alternative embodiments, screen 40 may be omitted or replaced by one or more openings.

In one embodiment foot spa apparatus 10 may include an air line 44 coupled to screen 40 to control the outflow of air mixed in the fluid streams through nozzle systems 30 and 32. According to an exemplary embodiment, air line 44 may comprise a hose or standpipe. According to alternative embodiments, air line 44 may comprise other devices (e.g., cylinders, pipettes, pipes, lines, inlets, channels, etc.). Air line 44 is generally positioned to bring air to the low pressure side 46 of impeller 16 and to mix air into the fluid stream. In addition, air line 44 may include a valve 48 to regulate the amount of air in the fluid stream. In the particular embodiment illustrated, valve 48 is controlled by an air line switch 50 located on a handset 52. Alternatively, valve 48 may be controlled by other electronic or mechanical devices (e.g., button, knob, etc.). Moreover, in alternative embodiments, air line 44 and/or valve 48 may be omitted.

According to an exemplary embodiment, spa apparatus 10 includes a motor 18. Motor 18 may be enclosed in a motor housing 54 and coupled to belt 56 so that when motor 18 operates, belt 56 rotates in a cyclical manner. Belt 56 may also be coupled to a shaft 58 which is supported by bearings 60 and secured within a shaft housing 55. Shaft 58 is further coupled to impeller 16 so that the cyclical rotation of belt 56 also rotates impeller 16. Consequently, the rotation of impeller 16 causes the fluid to be drawn in through screen 40 and out through nozzle systems 30 and 32.

Referring to FIG. 2, spa apparatus 10 may include a circular duct 62 that can either be coupled to impeller 16 or to foot rest plate 14 proximate the opening of inlet or intake 61. The circular duct acts to confine the water flow around impeller 16. Circular duct 62 may extend from the opening of inlet 61 and extend downward surrounding impeller 16. Circular duct 62 includes a lower edge 90 that is located a predetermined distance above the floor 27 to allow water being drawn into inlet 61 to be guided downward through the duct 62 into zone 36 and out of openings 31 and 33. It is possible to couple the circular duct 62 directly to the ends of the impeller blades, such that the duct 62 rotates with the impeller 16. In this embodiment, the duct should be located as close as possible to the opening of inlet 61 and to the circumference of the opening.

A duct seal 64 coupled to basin 12 and shaft housing 55 also keeps the fluid in basin 12 from escaping out of the apparatus. Spa apparatus 10 may also include a drain 66 for releasing at least some of the fluid from basin 12. Drain 66 is located on the lower portion 20 of basin 12.

A sensor switch 68 located within apparatus 10 senses when foot rest plate 14 is in position. In addition, sensor switch 68 senses when screen 40 is in position. Upon sensing that either screen 40 or foot rest plate 14 are out of position, sensor switch 68 shuts off power to motor 18 to prevent the operation of motor 18. Sensor switch 68, therefore, acts as a safety mechanism to reduce the risk of accidental injury caused by the operation of impeller 16.

Referring to FIGS. 3 and 6, foot rest plate 14 is configured so that a foot may rest at an angle relative to the horizontal plane within spa apparatus 10. Referring to FIG. 6, foot rest plate 14 includes radiused surface 70 that supports the foot during operation of apparatus 10. According to a preferred embodiment, radiused surface 70 has a radius of about 20 inches. Further, radiused surface 70 is about 10 inches in length. Of course the length of radiused surface 70 could be longer or shorter to accommodate variations in size of most feet. Foot rest plate 14 may also include backing 72 to further support a user's heel. Backing 72 may be configured at an angle for added comfort. According to a preferred embodiment, backing 72 is configured at an angle of about 15 degrees with respect to the horizontal plane. Further, backing 72 is about 3 inches in length.

Radius 76 enables a user to position their toes within the stream of water exiting opening 31 according to the user's desired configuration. For example, depending on the position of a user's foot, the stream of water may flow against the toes, over the foot, under the foot, around the foot, etc. The location and angle of the foot determines how the stream of water flows relative to the foot. Radius 76 extends from radiused surface 70 to create toe region 80. According to a preferred embodiment, heel region 78 is positioned lower than toe region 80 so that a user may angle their foot upward from heel to toes.

The operation of spa apparatus 10 will now be described. According to a preferred embodiment, foot rest plate 14 is positioned within basin 12 prior to use such that neoprene sealing ring 29 comes into contact with the floor 27 of basin 12. As a result zone 36 is formed between the underside 82 of foot rest plate 14, the lower ridges 21, and the floor 27 of basin 12. Fluid is placed in basin 12 up to a desired level above the upper surface 84 of foot rest 14. Prior to operation of motor 18, water will fill zone 36 by entering through openings 31 and 33 and through intake 61. Operation of motor 18 causes impeller 16 to rotate and consequently draw fluid from basin 12 through screen 40 and inlet 61 through circular duct 62 and into zone 36. The rotation of impeller 16 creates a low pressure zone 38 above foot rest plate 14 and a high pressure zone 36 below foot rest plate 14. This difference in pressure causes the fluid to move from basin 12 down through circular duct 62 and eventually out through openings 31 and 33. Further, the shape and angles of foot rest plate 14 guide the exiting fluid from opening 31 against, under, over, and around the front of a user's foot positioned within spa apparatus 10. Similarly, the shape and angles of foot rest plate 14 guide the exiting fluid from opening 33 against the back of the heel and around the foot.

In one embodiment, the pressure differential between the high pressure zone 36 and low pressure zone 38 is approximately two psi. Of course the pressure differential may be greater than or less than two psi and may be adjusted. However, pressure substantially above two psi results in a flow that is turbulent and may also result in an uncomfortable effect on a user's feet. In one embodiment, water is circulated at 60 gpm with approximately 4.3 gpm through each of openings 31, 33. Of course other pressure differentials and flow rates may be selected by increasing the speed of the impeller or the size and/or number of openings 31, 33.

As described above in a preferred embodiment, water exits opening 31 at an angle of about 8 degrees with respect to the horizontal plane. This angle allows the water to be directed over the top of a user's foot if the user's foot is moved back toward opening 33 at the heel region. By moving one's foot away from the heel region and toward nozzle system 31, the water from opening 31 may be directed under the toes or heel of one's foot. This allows the user to determine where the water exiting the opening 31 should be directed. The recessed location of opening 31 due to the curvature and/or shape of foot rest plate 14 makes it difficult for a user to block the openings thereby disrupting the balance of the water flow. Additionally it is believed that being too close to the opening does not produce a pleasant affect. The location of opening 31 and the shape of foot rest plate 14 help ensure that a user's foot will not entirely come into contact with the openings during operation of the system. Water exits opening 33 an angle of about 15 degrees relative to the horizontal plane. Referring to FIG. 6, the stream of water exiting opening 31 forms an included angle 88 of 23 degrees with the stream of water exiting from opening 33.

Referring to FIG. 9, in an alternative embodiment, foot rest plate 14 may include recessed cavity 34 where nozzle system 30 is located. Recessed cavity 34 allows nozzle system 30 to direct a stream of fluid in a non-vertical direction and makes it difficult for a user to block the openings thereby disrupting the balance of the water flow. In addition, foot rest plate may include incline surface 100 and slope 102. Incline surface 100 and slope 102 help support the foot during operation of apparatus 10.

During cleaning of spa apparatus 10, foot rest plate 14 may be easily and conveniently removed from basin 12 without the use of tools. Referring to FIG. 7, drain 66 may be opened before foot rest plate 14 is removed so that fluid flows out of basin 12. Caps 92 may then be removed from fasteners 94. Similarly, screen 40 may then be removed by moving tab 42 so that it no longer abuts edge 43 on console 26. After removing caps 92 and/or screen 40, foot rest plate 14 may be lifted out of position from within basin 12. After foot rest plate 14 has been removed, spa apparatus 10 may be mechanically scrubbed and cleaned. The ability to remove foot rest plate 14 enables a user to quickly and efficiently clean each piece of apparatus 10 that comes into contact with fluid during operation, including impeller 16, basin 12, console 26, foot rest plate 14, etc. After cleaning apparatus 10, basin 12 and the other components may be rinsed out. Once apparatus 10 is cleaned, foot rest plate 14 may easily be re-positioned back within basin 12. After foot rest plate 14 has been positioned within basin 12, caps 92 may be coupled to fasteners 94 to retain foot rest plate 14 in position. Similarly, screen 40 may be positioned over inlet 61 of foot rest plate 14 and coupled to console 26 and/or foot rest plate 14. Apparatus 10 may be cleaned as needed to maintain the desired water quality.

Figure 10:
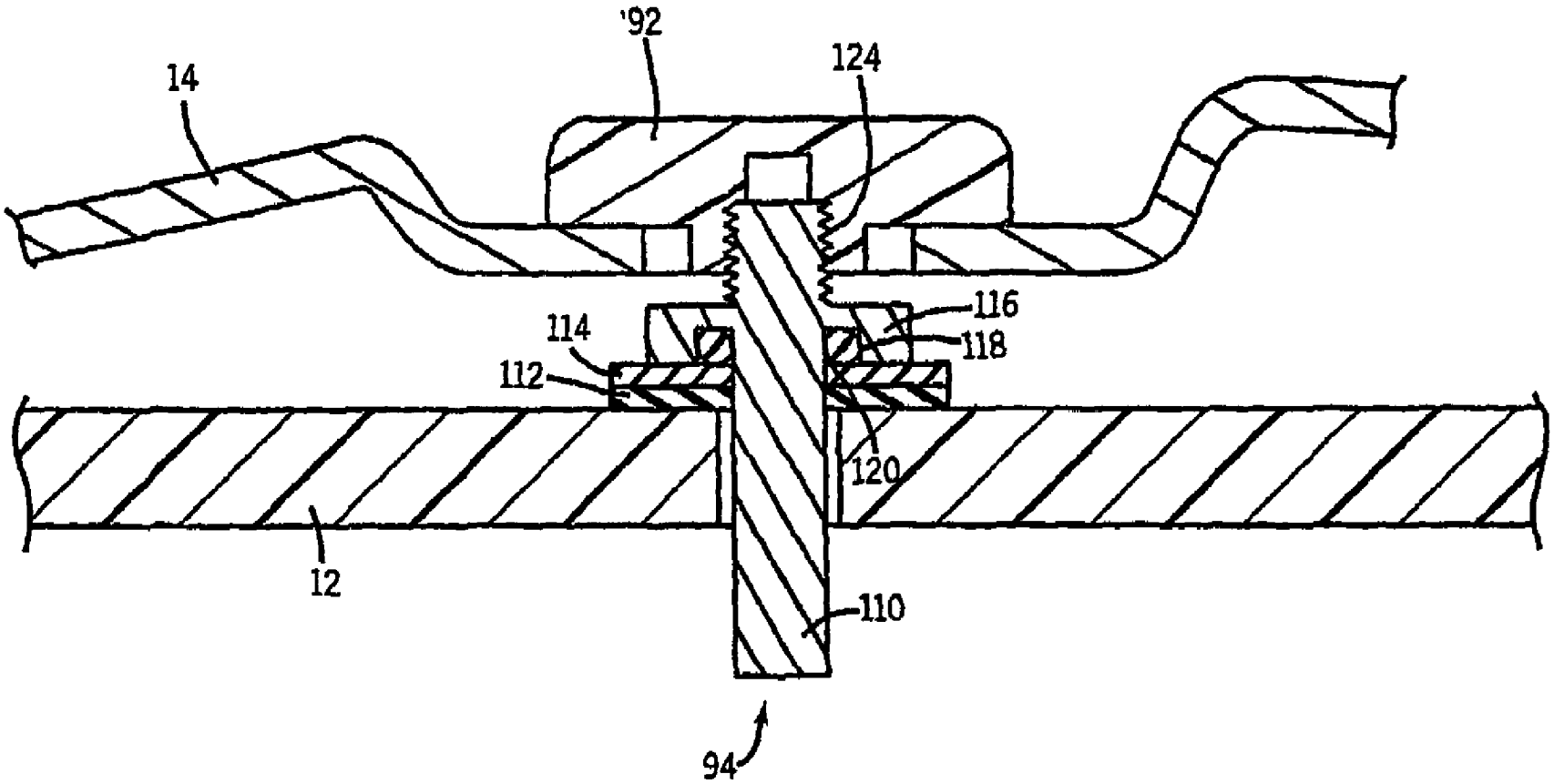
FIG. 10 is a cross-sectional view of the fastener for the foot rest plate of FIG. 6.

Referring to FIG. 10, fastener 94 includes stud 110 which extends through basin 12. Stud 110 includes a shoulder portion 116 which has a circular groove 120. Circular groove 120 houses an O-ring 118 to act as a seal to prevent water from flowing between stud 110 and basin 12. Further, stud 110 and shoulder portion 116 are positioned to couple with steel washer 114 which couples with rubber washer 112. Rubber washer 112 couples with basin 12 and forms a seal to prevent water from leaking out of apparatus 10 during operation of the system. In addition, fasteners 94 include threaded portions 124. Stud 110 includes male threads whereas rubber cap 92 includes female threads. Rubber cap 92 may therefore be threaded onto the threaded portion 124 of fastener 94 to a desired tension. As rubber cap 92 is threaded onto fastener 94, a seal is formed between rubber cap 92 and foot rest 14. This seal prevents water from leaking between underside 82 and upper surface 84 of foot rest 14. Once cap 92 is attached to fastener 110, foot rest plate 14 may be retained in position so that foot rest 14 is not dislodged by the water pressure created during operation of apparatus 10.

Figure 11:
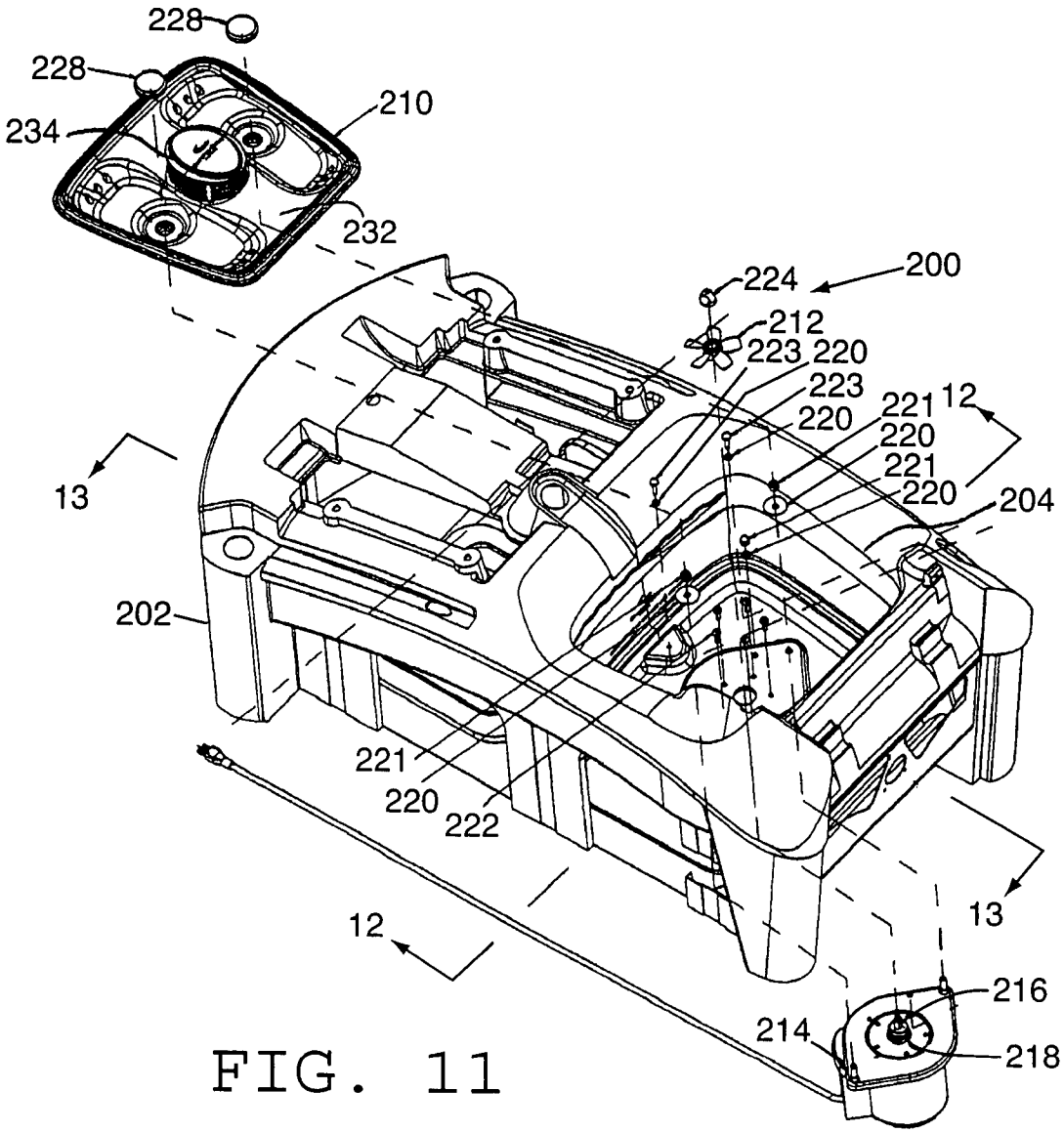
FIG. 11 is an exploded perspective view of another exemplary embodiment of a spa apparatus in accordance with the present invention.
Figure 12:
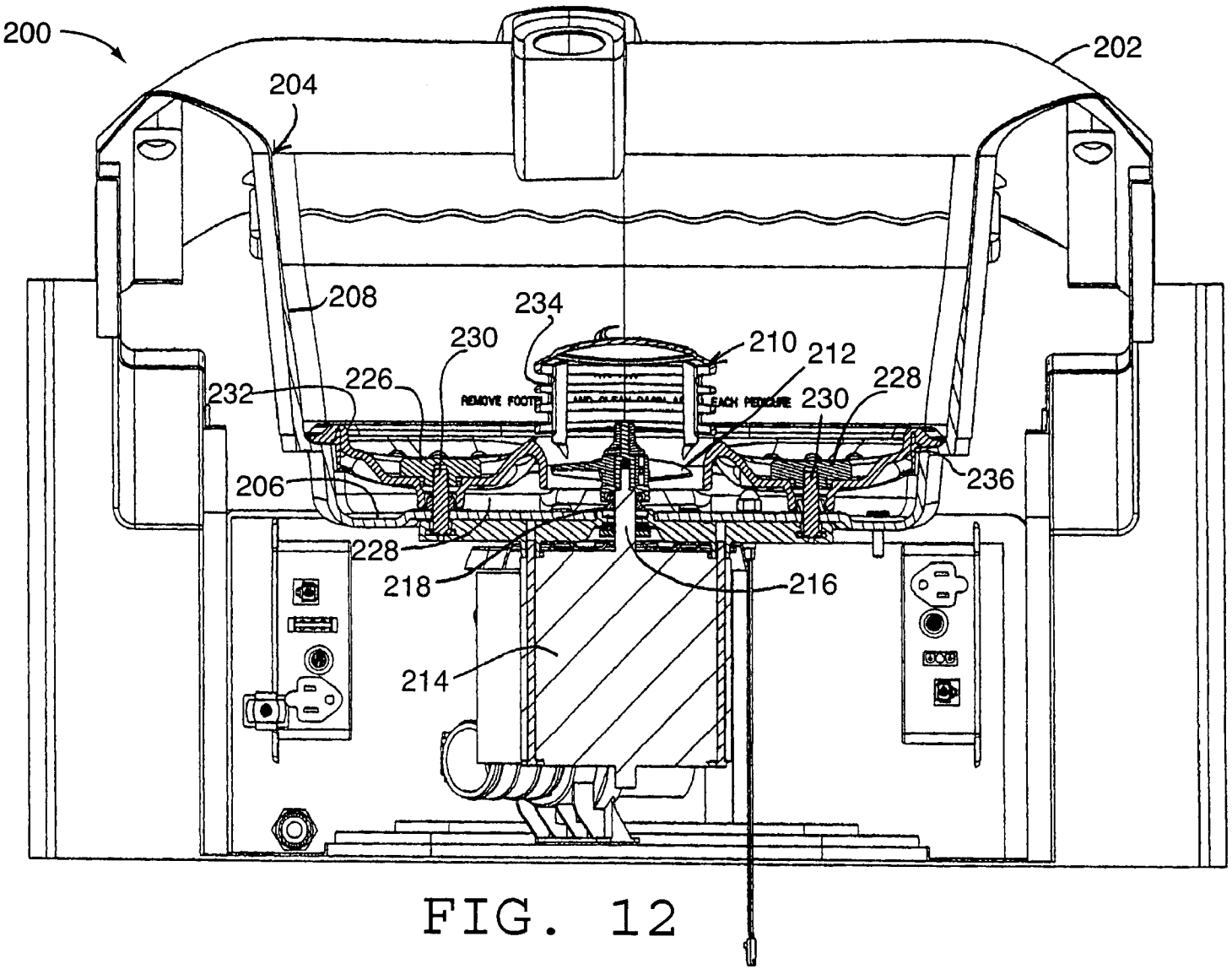
FIG. 12 is a cross sectional view of the assembled exemplary spa apparatus of FIG. 11 as taken generally along the line 12-12 thereof.
Figure 13:
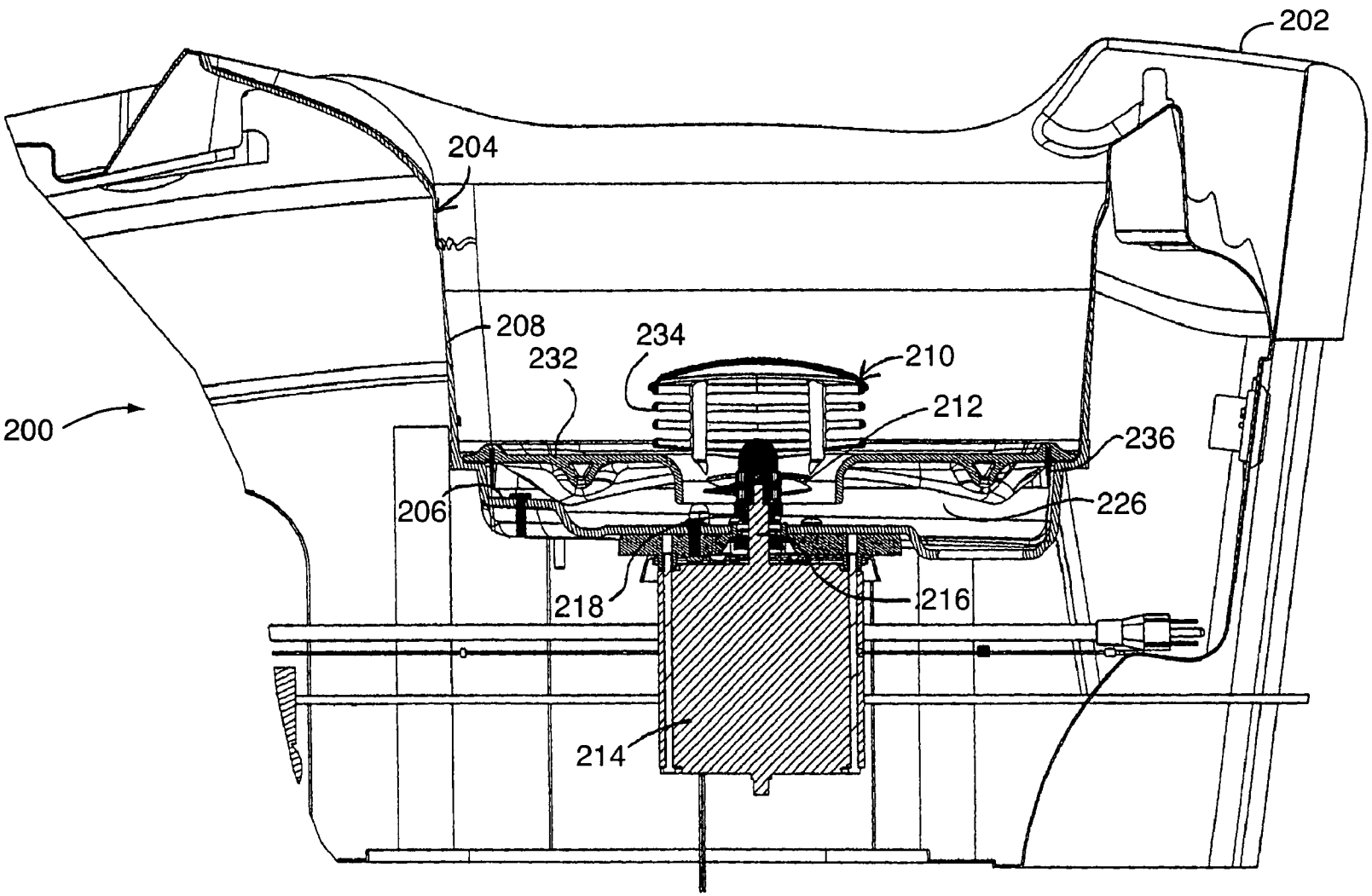
FIG. 13 is a partial cross sectional view of the assembled exemplary spa apparatus of FIG. 11 as taken generally along the line 13-13 thereof.

Another alternative preferred embodiment of a spa apparatus 200 in accordance with the present invention is illustrated in, and will be described with reference to, FIGS. 11-13. The spa apparatus 200 includes a shell or base 202. A portion of the shell 202 forms or defines a spa basin 204, which, as described above, is configured to retain fluid (e.g., water) for use with various cleaning and/or massage activities. The basin 204 is defined by a bottom 206 and side walls 208. Spa apparatus 200 also includes a foot rest plate assembly 210, adapted to be positioned within the basin 204, an impeller 212 mounted within the basin 204, and a motor 214 mounted within the shell 202 and located external to the basin 204 for rotating the impeller 212 so that fluid is directed through the foot rest plate assembly 210.

Foot rest plate assembly 210 is positioned in a lower portion of the basin 204. As discussed above, the foot rest plate assembly 210 is removably coupled to the basin 204 below the fluid surface. As will be discussed in more detail below, the foot rest plate assembly 210 forms a seal with the basin 204 to restrict the flow of fluid around the foot rest plate assembly 210 between the plate assembly 210 and the basin 204.

The motor 214 is mounted within the shell 212 such that the rotatable motor shaft 216 extends through an aperture in the bottom 206 of the basin 204 up into the basin 204. Any appropriate dynamic sealing structure 218 may be provided between the motor shaft 216 and the basin 204 to prevent leakage of fluid from the basin 204 around the motor shaft 216. The motor 214 may be mounted to the bottom 206 of the basin using an appropriate combination of fasteners which may include, for example, washers 220, nuts 221, screws 222, and bolts 223, etc.

The impeller 212 is attached to the end of the motor shaft 216 extending into the basin 204 in a conventional manner. For example, a clamp knob 224 may be used removably to attach the impeller 212 to the motor shaft 216. In operation, the impeller 212 is rotated by the motor 214, via the motor shaft 216, to draw fluid downward from a portion of the basin 204 located above the foot rest plate assembly 210, thereby to create a relatively high pressure zone 226 underneath the foot rest plate assembly 210, between the foot rest plate assembly 210 and thee bottom 206 of the basin 204. This pressurized water is then ejected through apertures formed in the plate assemble 210, as described above and in more detail below.

As discussed above, the foot rest plate assembly 210 may be mounted in the basin 204 using threaded caps 228. The threaded caps 228 are threaded onto fasteners 230 which are mounted in the bottom 206 of the basin 204 so as to extend upward therefrom through apertures formed through the foot rest plate assembly 210. As discussed above, the caps 228 may be formed of rubber or a similar material such that when the caps 228 are threaded onto the fasteners 230 and tightened down onto the foot rest plate assembly 210 a seal is formed between the caps 228 and the plate assembly 210 to prevent fluid leakage.

Figure 14:
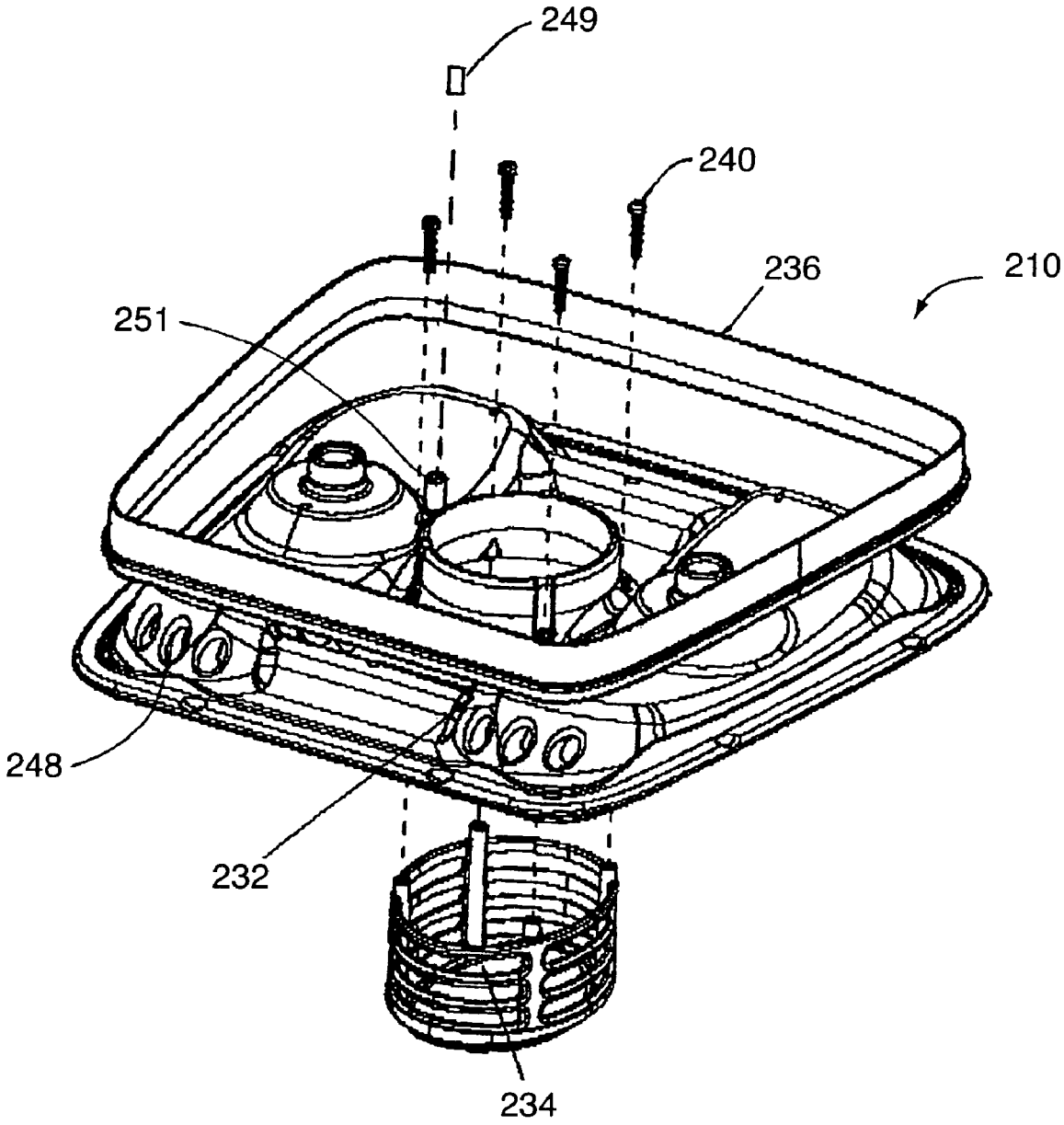
FIG. 14 is an exploded perspective view of an exemplary embodiment of a foot plate assembly in accordance with the present invention.

As illustrated in FIG. 14, the three main components of the foot rest plate assembly 210 include a foot plate 232, an inlet cover 234, and a foot plate seal or gasket 236.

Figure 15:
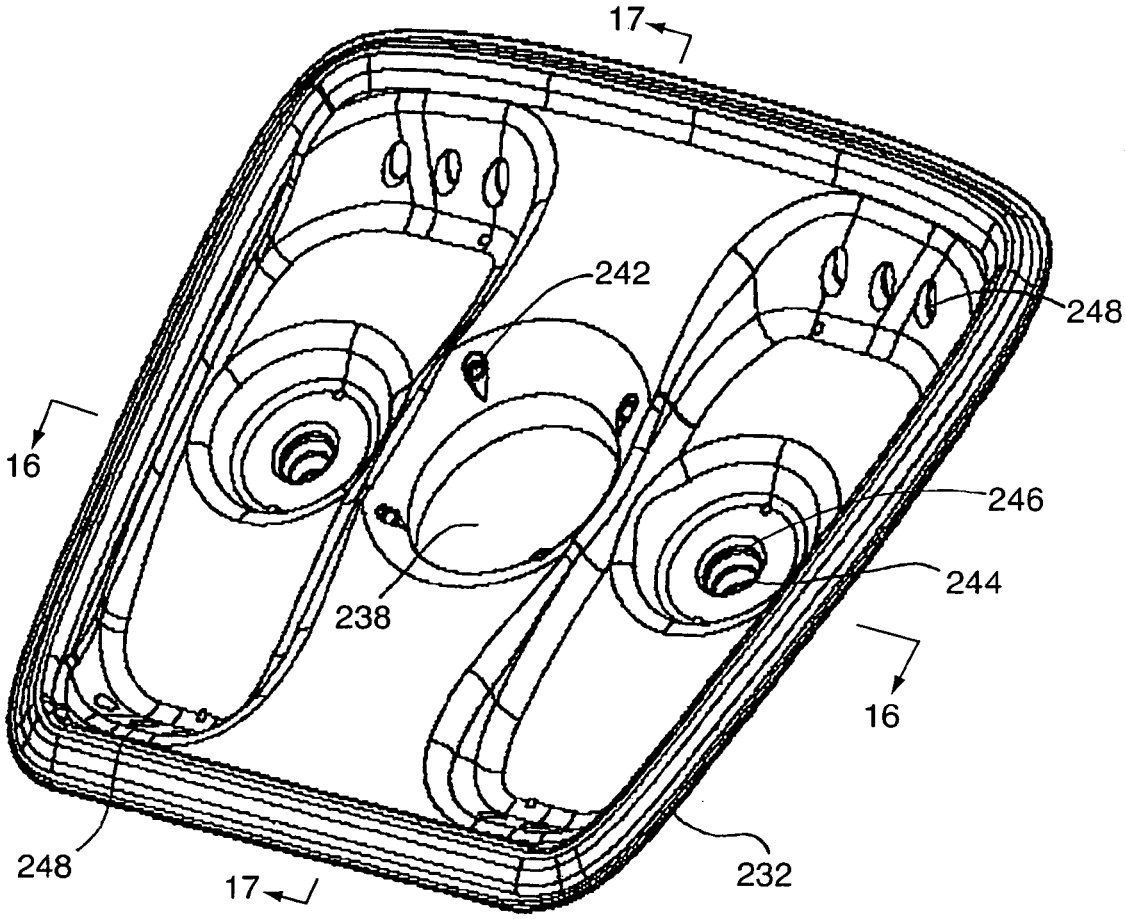
FIG. 15 is a perspective view of an exemplary embodiment of a foot plate in accordance with the present invention.
Figure 16:
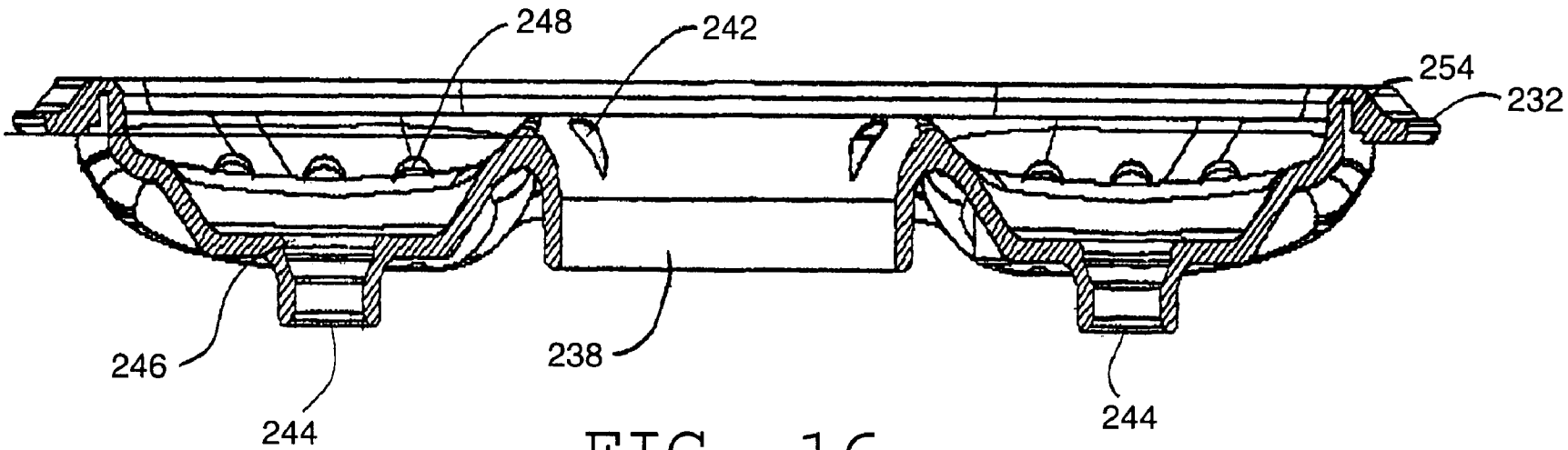
FIGS. 16 and 17 are cross sectional views of the exemplary foot plate illustrated in FIG. 15 as taken along lines 16-16 and 17-17 thereof, respectively.
Figure 17:
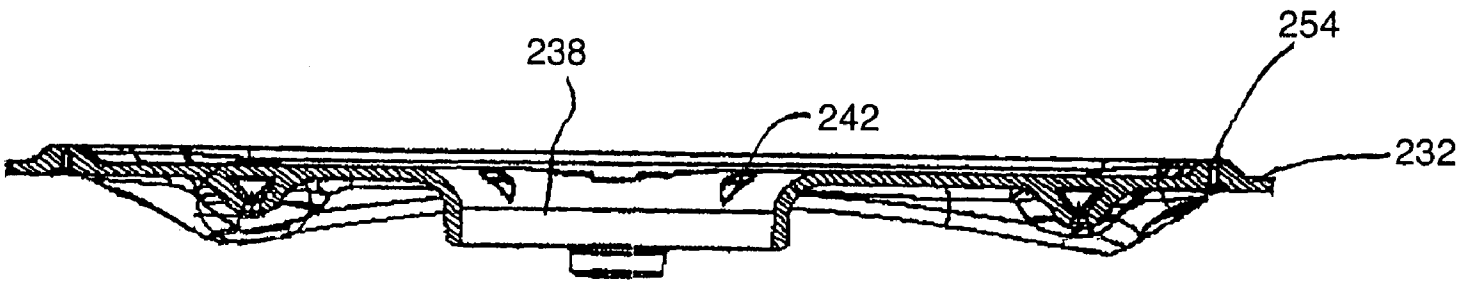

An exemplary foot plate 232 in accordance with the present invention is illustrated in FIGS. 15-17. The foot plate 232 has an inlet aperture 238 formed therein such that when the foot plate assembly 210 is mounted in the basin 204 the inlet aperture 238 is aligned with the impeller 212 such that fluid is drawn downward through the inlet aperture 238 by the impeller 212 to form the high pressure zone 226 beneath the foot plate assembly 210 between the foot plate assembly 210 and the bottom 206 of the basin 204. The inlet aperture 238 of the foot plate 232 is covered by the inlet cover 234. The inlet cover 234 acts as a screening and safety device that allows fluid easily to be drawn therethrough into the inlet aperture 238 while preventing any part of a user's body, or any other object, from entering the aperture 238 where it may be damaged by, or cause damage to, the rotating impeller 212. The inlet cover 234 may be mounted to the foot plate 232 in a conventional manner, e.g., using fasteners such as screws 240. Fastener holes 242 may be formed through the foot plate 232 around the inlet aperture 238 through which the fasteners 240 may be extended to mount the inlet cover 234 to the foot plate 232.

The foot plate 232 also has mounting apertures 244 formed therethrough. The mounting apertures 244 are formed on the foot plate 232 such that the fasteners 230 mounted in the bottom 206 of the basin 204 extend upward through the mounting apertures 244 when the foot rest plate assembly 210 is positioned in the basin 204. The area 246 around the mounting apertures 244 on the foot plate 232 is formed to interact with the caps 228 to form a seal when the caps are threaded onto the fasteners 230 and tightened down onto the foot plate 232. Note also that the portion 246 of the footplate 232 around the mounting apertures 244 preferably extends downward such that the bottom of the foot plate 232 in this area 246 contacts the bottom 206 of the basin 204 when the caps are tightened down on to the foot plate 232. Thus, the area 246 of the footplate 232 around the mounting apertures 244 provides support for the foot plate 232 against the bottom 206 of the basin 204 so that bending and distortion of the foot plate 232, especially if the footplate 232 is made of a plastic material, by a user standing on or otherwise applying pressure to the top of the footplate is minimized.

As discussed above, the foot plate 232 also has apertures formed therein that form one or more nozzle systems 248. When the foot rest plate assembly 210 is positioned in the basin 204 the nozzle systems 248 are in fluid communication with the high pressure zone 226 underneath the plate assembly 210. Thus, pressurized fluid is directed through the nozzle systems 248 onto a user's feet. As discussed above, the nozzle systems 248 may be formed in the foot plate 232 to direct fluid at the desired angles and at the desired pressures to create a pleasurable water massage effect for user's, to minimize a fountain effect, etc. Also as discussed above, the foot plate 232 may be designed and contoured to provide a comfortable surface to support a user's feet while allowing the user to move her feet with respect to the fluid flow through the nozzle systems 248 to create the desired massage effect.

As illustrated in FIG. 14, the foot plate 232 also preferably may have a magnet 249 mounted therein, e.g., in an appropriate magnet holding receptacle 251 formed in the footplate 232. When the foot rest plate assembly 210 is mounted in proper position in the basin 204, the presence of the magnet 249 is detected by an appropriate magnetic field detector (e.g., a magnetically sensitive switch) (not shown) mounted in the basin 204. If the presence of the magnet 249 is not detected it is assumed that the foot rest plate assembly 210 is not in proper position in the basin 204 and operation of the motor 214 is prevented. Thus, the magnet 249 in the foot plate 232 in combination with the sensor acts as a safety mechanism, as described above, to reduce the risk of accidental injury caused by operation of the impeller 212 when the foot rest plate assembly 210 is not properly installed.

In accordance with the present invention, the foot plate 232 may be formed of a plastic material. For example, a plastic material such as glass polypropylene or any other similar or different plastic material that does not absorb water may be used to form the foot plate 232. The foot plate 232 thus may be formed relatively inexpensively using a plastic molding or other plastic object manufacturing process.

It is important that the foot plate 232 be formed such that the foot rest plate assembly 210 may be mounted in the basin 204 such that a seal is maintained around the periphery of the foot plate 232, between the foot plate 232 and the basin 204, such that the pressure in the high pressure zone 226 underneath the foot plate may be maintained. This is particularly important where the foot plate 232 is made of a material such as plastic, which may be subject to displacement and distortion from the relatively high fluid pressure underneath the plate 232.

Figure 18:
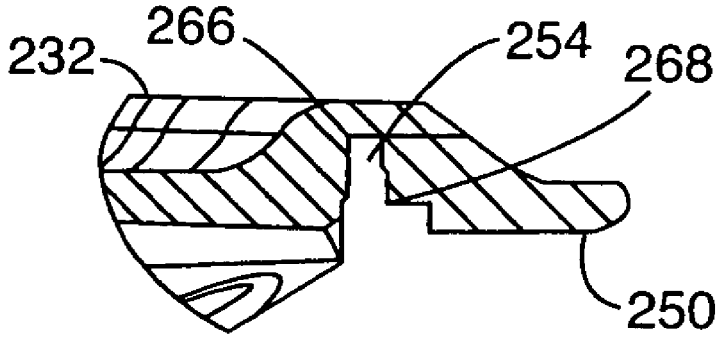
FIG. 18 is a detailed cross sectional view of a portion of the exemplary foot plate illustrated in FIG. 15 showing in more detail a groove formed therein for supporting a foot plate sealing gasket in accordance with the present invention.

As illustrated in detail in FIG. 18, the outer periphery of the foot plate 232 may be formed to include a generally horizontal flange 250 extending around the periphery of the foot plate 232. The horizontal flange 250 of the foot plate 232 is designed to rest on a substantially horizontal shelf 252 extending from the side wall 208 of the basin 204 around the basin 204. Thus, the foot rest plate assembly 210 may be supported in position in the basin 204 by the horizontal flange 250 of the foot plate 232 resting on the horizontal shelf 252.

Figure 20:
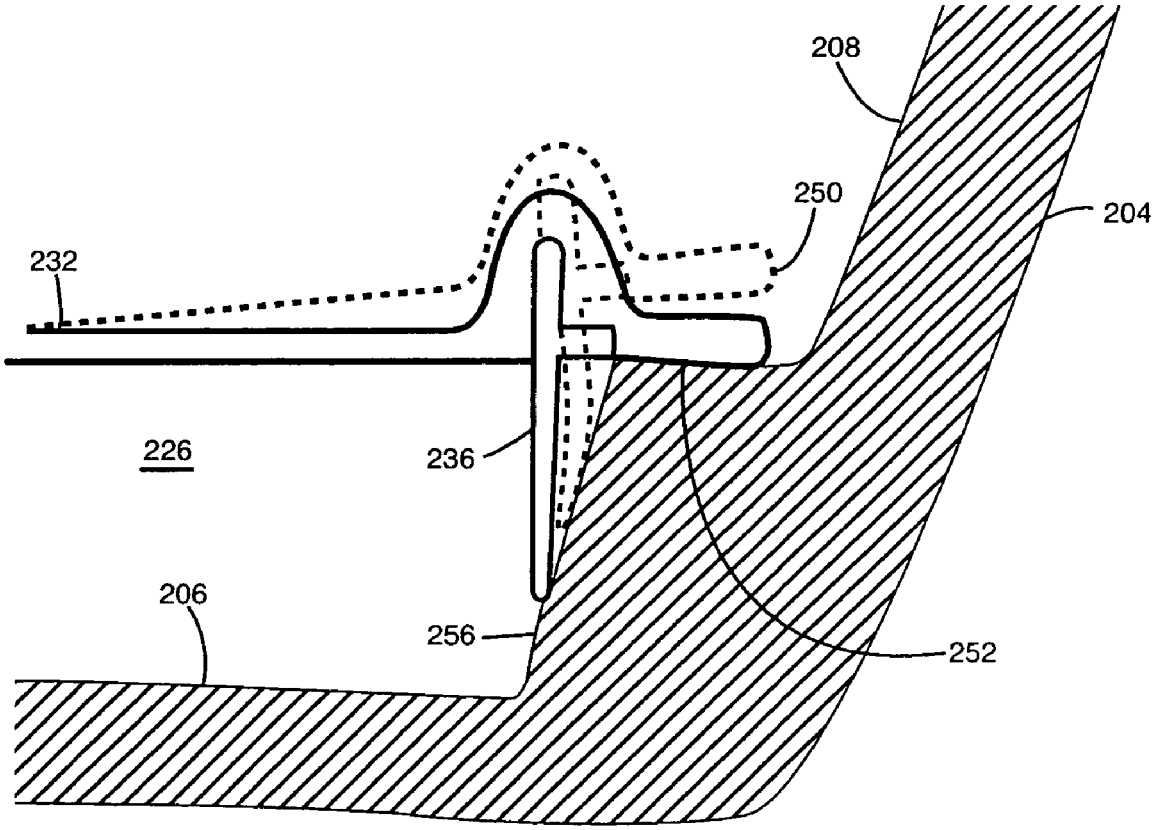
FIG. 20 is an exemplary detailed cross sectional view of a portion of a spa apparatus in accordance with the present invention showing operation of a foot plate seal in accordance with the present invention to maintain and enhance a seal between a foot plate and a spa basin when the foot plate is deflected and distorted by water pressure beneath the foot plate.

A channel 254 is formed around the periphery of the foot plate 232 inward from the horizontal flange 250. The channel 254 is formed and positioned to support the seal 236 such that the seal 236 extends downward from the foot plate 232 along a substantially vertical portion 256 of the side wall 208 of the basin 204 that extends below the horizontal shelf 252. As illustrated in FIG. 20, the seal 236 contacts the vertical side wall portion 256 to form a seal between the foot plate 232 and the basin 204. If the foot plate 232 is deflected or deformed from the pressure underneath the plate 232 the horizontal flange portion 250 thereof may be lifted off of the horizontal shelf 252 formed in the side wall 208 of the basin 204. (See the dashed portion of FIG. 20.) Nevertheless, in such a case the seal between the plate 232 and the basin 204 is maintained by the seal 236 as the seal 236 is moved toward and against the vertical side wall portion 256 to maintain and enhance the seal therebetween.

Figure 19:
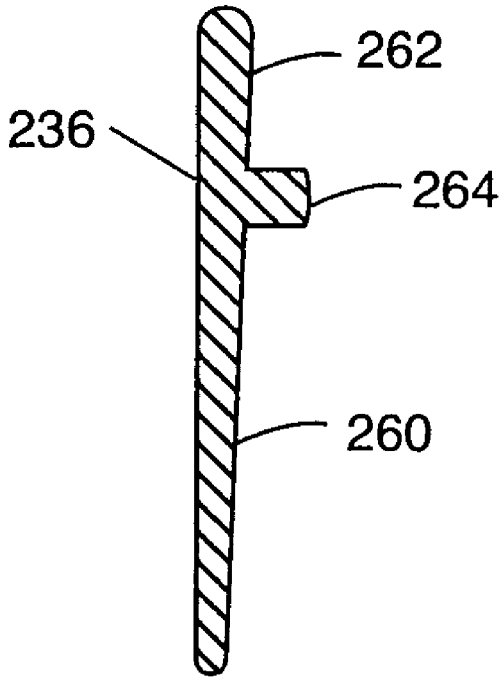
FIG. 19 is a cross sectional view of an exemplary foot plate sealing gasket in accordance with the present invention.

A cross section of an exemplary seal 236 that may be employed for this purpose is illustrated in FIG. 19. This seal 236 may be made of a flexible material, such as Santoprene, silicone rubber, TPR (thermo plastic rubber), EPDM (ethylene-propylene-diene rubber, etc.), or some other appropriate material that is both flexible and, preferably, easy to clean. Such a seal can be manufactured inexpensively by an extrusion process. The seal 236 preferably is symmetrical along its length, so that its sealing characteristics do not change as the seal is bent around the corners of the foot plate 232 in which it is mounted. As illustrated, the seal 236 has a vertical sealing portion 260 that extends downward from the foot plate 232 in which the seal is mounted. This vertical sealing portion 260 cooperates with a portion 256 of the side wall 208 of the basin 204 to form a seal. A vertical mounting portion 262 and a horizontal mounting portion 264 of the seal 236 are mounted in vertical 266 and horizontal 268 portions of the channel 254 formed in the foot plate 232. The horizontal mounting portion 264 preferably may be formed to extend in an outward direction from the vertical mounting portion 262 and vertical sealing portion 260 of the seal 236. The mounting portions 262 and 264 of the seal 236 are leveraged by the corresponding portions 266 and 268 of the channel 254 if the foot plate 232 is distorted to flex the vertical sealing portion 260 against the portion 256 of the side wall 208 of the basin 204 to maintain the seal between the foot plate assembly 210 and the basin in such case.

It should be understood that the seal 236 and sealing method described with reference to FIG. 20 may be employed to provide sealing for spa foot plates other than those described and illustrated herein, including such spa foot plates made of plastic or non-plastic materials.

It is also important to note that the construction and arrangement of the elements of the spa apparatus as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the basin of the spa apparatus may be made from borosilicate or other suitable material. Further, other components of the spa apparatus may be manufactured from thermoplastic resins such as injection molded high density polyethylene, polypropylene, other polyethylenes, acrylonitrile butadiene styrene ("ABS"), polyurethane, nylon, any of a variety of homopolymer plastics, copolymer plastics, plastics with special additives, filled plastics, steel, aluminum, alloys, etc. Also, other fabricating, stamping, or molding operations may be used to form these components. Accordingly, all such modifications are intended to be included within the scope of the present invention as defined in this application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention.

What is claimed is:

1. A spa apparatus comprising:

(a) a basin for retaining fluid and having a bottom wall and side walls;

(b) a foot rest plate having an inlet opening and at least one outlet nozzle;

(c) an impeller;

(d) a motor coupled to drive the impeller to draw fluid through the inlet opening into a high pressure zone between the bottom wall of the basin and the foot rest plate; and (e) a flexible seal formed between the foot rest plate and the side walls of the basin such that the seal is maintained if the foot rest plate is deflected by pressure in the high pressure zone.

2. The spa apparatus of claim 1 wherein the foot rest plate is made of plastic.

3. The spa apparatus of claim 2 wherein the foot rest plate is made of glass polypropylene.

4. The spa apparatus of claim 1 wherein the seal is made of a flexible material selected from the group of flexible materials consisting of Santoprene, silicone rubber, TPR (thermo plastic rubber), and EPDM (ethylene-propylene-diene rubber).

5. The spa apparatus of claim 1 wherein the seal is made by an extrusion process.

6. The spa apparatus of claim 1 wherein the seal includes a vertical sealing portion that extends downward from the foot rest plate adjacent to the basin side walls and engages the basin sidewalls to form a seal.

7. The spa apparatus of claim 1 wherein the foot rest plate includes a seal mounting channel formed in a bottom surface thereof and wherein the seal is mounted in the seal mounting channel and extends downward therefrom.

8. The spa apparatus of claim 7 wherein the basin includes a substantially horizontal shelf formed in the sidewalls thereof, the foot rest plate includes a substantially horizontally oriented peripheral flange and is positioned with respect to the basin such that the substantially horizontally oriented peripheral flange rests on the substantially horizontal shelf in the sidewalls of the basin, and wherein the seal mounting channel is formed in the bottom surface of the foot rest plate inward from the substantially horizontally oriented peripheral flange such that the seal mounted therein extends downward therefrom adjacent to the basin sidewalls.

9. The spa apparatus of claim 1 wherein the foot rest plate and seal are removably positioned in the basin.

10. A spa apparatus comprising:

(a) a basin for retaining fluid and having a bottom wall and substantially vertical side walls and a substantially horizontal shelf formed in the sidewalls;

(b) a foot rest plate having an inlet opening and at least one outlet nozzle, a substantially horizontally oriented peripheral flange positioned with respect to the basin such that the substantially horizontally oriented peripheral flange rests on the substantially horizontal shelf formed in the sidewalls of the basin, and a seal mounting channel formed in a bottom surface thereof inward from the substantially horizontally oriented peripheral flange;

(c) an impeller;

(d) a motor coupled to drive the impeller to draw fluid through the inlet opening into a high pressure zone between the bottom wall of the basin and the foot rest plate; and (e) a flexible seal mounted in the seal mounting channel and having a vertical sealing portion extending downward therefrom along the side walls of the basin to engage the sidewalls of the basin form a seal between the foot rest plate and the side walls of the basin.

11. The spa apparatus of claim 10 wherein the foot rest plate is made of plastic.

12. The spa apparatus of claim 11 wherein the foot rest plate is made of glass polypropylene.

13. The spa apparatus of claim 10 wherein the seal is made of a flexible material selected from the group of flexible materials consisting of Santoprene, silicone rubber, TPR (thermo plastic rubber), and EPDM (ethylene-propylene-diene rubber).

14. The spa apparatus of claim 10 wherein the seal is made by an extrusion process.

15. The spa apparatus of claim 10 wherein the seal includes a substantially vertical mounting portion and a substantially horizontal mounting portion and wherein the seal mounting channel has a substantially vertical channel portion adapted to receive the substantially vertical mounting portion of the of the seal and a substantially horizontal channel portion adapted to receive the substantially horizontal mounting portion of the seal.

16. The spa apparatus of claim 15 wherein the substantially horizontal mounting portion of the seal extends in an outward direction toward the basin from the substantially vertical mounting portion and the substantially vertical sealing portion thereof and wherein the substantially horizontal channel portion of the seal mounting channel extends toward a peripheral edge of the foot rest plate from the substantially vertical channel portion thereof.

17. The spa apparatus of claim 10 wherein the foot rest plate and seal are removably positioned in the basin.

18. A foot rest plate assembly for a spa including a basin for retaining fluid and having a bottom wall and substantially vertical side walls and a substantially horizontal shelf formed in the sidewalls, an impeller, and a motor coupled to drive the impeller to draw fluid through the foot rest plate assembly into a high pressure zone between the bottom wall of the basin and the foot rest plate assembly, comprising:

(a) a foot rest plate having an inlet opening and at least one outlet nozzle, a substantially horizontally oriented peripheral flange positioned with respect to the basin such that the substantially horizontally oriented peripheral flange rests on the substantially horizontal shelf formed in the sidewalls of the basin, and a seal mounting channel formed in a bottom surface thereof inward from the substantially horizontally oriented peripheral flange; and (b) a flexible seal mounted in the seal mounting channel and having a vertical sealing portion extending downward therefrom along the side walls of the basin to engage the sidewalls of the basin form a seal between the foot rest plate and the side walls of the basin.

19. The foot rest plate assembly of claim 18 wherein the foot rest plate is made of plastic.

20. The foot rest plate assembly of claim 19 wherein the foot rest plate is made of glass polypropylene.

21. The foot rest plate assembly of claim 18 wherein the seal is made of a flexible material selected from the group of flexible materials consisting of Santoprene, silicone rubber, TPR (thermo plastic rubber), and EPDM (ethylene-propylene-diene rubber).

22. The foot rest plate assembly of claim 18 wherein the seal is made by an extrusion process.

23. The foot rest plate assembly of claim 18 wherein the seal includes a substantially vertical mounting portion and a substantially horizontal mounting portion and wherein the seal mounting channel has a substantially vertical channel portion adapted to receive the substantially vertical mounting portion of the of the seal and a substantially horizontal channel portion adapted to receive the substantially horizontal mounting portion of the seal.

24. The foot rest plate assembly of claim 23 wherein the substantially horizontal mounting portion of the seal extends in an outward direction from the substantially vertical mounting portion and the substantially vertical sealing portion thereof and wherein the substantially horizontal channel portion of the seal mounting channel extends toward a peripheral edge of the foot rest plate from the substantially vertical channel portion thereof.

* * * * *